US012345459B2

(12) United States Patent
Jeong et al.

(10) Patent No.: US 12,345,459 B2
(45) Date of Patent: Jul. 1, 2025

(54) REFRIGERATOR

(71) Applicant: SAMSUNG ELECTRONICS CO., LTD., Suwon-si (KR)

(72) Inventors: Jin Jeong, Suwon-si (KR); Juno Kwon, Suwon-si (KR); Sangmin Park, Suwon-si (KR); Gahyeong Kim, Suwon-si (KR); Dongho Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 203 days.

(21) Appl. No.: 18/076,703

(22) Filed: Dec. 7, 2022

(65) Prior Publication Data

US 2023/0251009 A1 Aug. 10, 2023

Related U.S. Application Data

(63) Continuation of application No. PCT/KR2022/017378, filed on Nov. 7, 2022.

(30) Foreign Application Priority Data

Feb. 10, 2022 (KR) ..... 10-2022-0017766
Apr. 15, 2022 (KR) ..... 10-2022-0047187

(51) Int. Cl.
*F25C 1/24* (2018.01)
*F25C 1/04* (2018.01)

(52) U.S. Cl.
CPC ..... *F25C 1/24* (2013.01); *F25C 1/04* (2013.01); *F25C 2400/04* (2013.01); *F25C 2400/08* (2013.01); *F25C 2400/10* (2013.01)

(58) Field of Classification Search
CPC .... F25C 1/24; F25C 2400/10; F25C 2400/08; F25C 2400/04; F25C 1/04
See application file for complete search history.

(56) References Cited

U.S. PATENT DOCUMENTS 3,019,612 A * 2/1962 Jaeger ..... F25C 1/12 62/347
8,522,571 B2 9/2013 Smith
(Continued)

FOREIGN PATENT DOCUMENTS

JP 9-178316 7/1997
JP 2003-42608 2/2003
(Continued)

OTHER PUBLICATIONS

Translated_Jang (Year: 2015).*
(Continued)

*Primary Examiner* — Jerry-Daryl Fletcher
*Assistant Examiner* — Samba Gaye
(74) *Attorney, Agent, or Firm* — STAAS & HALSEY LLP

(57) ABSTRACT

A refrigerator including an ice maker; an ice bucket including a first position guide; and a pad mountable to the ice bucket and including a base, an inclined member, and a second position guide. When the pad is being mounted to the ice bucket, the second position guide couples with the first position guide to guide positioning of the pad in the ice bucket so that, when the pad is mounted to the ice bucket, the base is in a front portion of the ice bucket and the inclined member is in a rear portion of the ice bucket and is inclined to the base. When the pad is mounted to the ice bucket and the ice bucket is positioned under the ice maker, ice produced by the ice maker falls into the ice bucket and is transferred by the inclined member to the base.

14 Claims, 21 Drawing Sheets

(56) References Cited

U.S. PATENT DOCUMENTS

| | | | | |
|---|---|---|---|---|
| 11,204,194 | B2 | 12/2021 | Kim et al. | |
| 2009/0205358 | A1* | 8/2009 | Smtih | F25C 5/182 312/401 |
| 2020/0158411 | A1* | 5/2020 | Kim | F25C 5/182 |
| 2021/0404726 | A1* | 12/2021 | Kim | F25D 29/00 |

FOREIGN PATENT DOCUMENTS

| | | | |
|---|---|---|---|
| JP | 2003232586 | A * | 8/2003 |
| JP | 4214701 | | 1/2009 |
| JP | 2018059693 | A * | 4/2018 |
| JP | 6911351 | | 7/2021 |
| KR | 20-1998-0019825 | | 7/1998 |
| KR | 20-0118660 | | 7/1998 |
| KR | 1998-019825 | | 7/1998 |
| KR | 10-2006-0018141 | | 2/2006 |
| KR | 10-2010-0018995 | | 2/2010 |
| KR | 10-1038344 | | 5/2011 |
| KR | 10-2012-0097070 | | 9/2012 |
| KR | 2015098875 | A * | 8/2015 |
| KR | 10-2148457 | | 8/2020 |
| KR | 10-2188229 | | 12/2020 |
| KR | 10-2021-0026950 | | 3/2021 |
| KR | 10-2021-0071526 | | 6/2021 |

OTHER PUBLICATIONS

Translated_Yuichi (Year: 2018).*
Translated_Kazue (Year: 2003).*
International Search Report, PCT/ISA/210, dated Feb. 14, 2023, in International Application PCT/KR2022/017378.
Written Opinion, PCT/ISA/237, dated Feb. 14, 2023, in International Application PCT/KR2022/017378.
Supplementary European Search Report dated Jan. 31, 2025, for European Application No. EP 22 92 6183.

* cited by examiner

REFRIGERATOR

CROSS-REFERENCE TO RELATED APPLICATIONS

This application is a continuation application, under 35 U.S.C. § 111 (a), of international application No. PCT/KR2022/017378, filed on Nov. 7, 2022, which claims priority to Korean Patent Application No. 10-2022-0017766, filed on Feb. 10, 2022, and No. 10-2022-0047187, filed on Apr. 15, 2022, in the Korean Intellectual Property Office, the disclosures all of which are hereby incorporated by reference herein in their entireties.

BACKGROUND

1. Field

The disclosure relates to a refrigerator, and more particularly, to a refrigerator including an ice-making assembly including an improved structure.

2. Description of Related Art

A refrigerator is a home appliance that includes a main body including a storage compartment and a cold air supply device configured to supply cold air to the storage compartment to keep food fresh.

The refrigerator is also provided with an ice-making assembly. The ice-making assembly may include an ice maker configured to produce ice and an ice bucket provided to receive ice produced by the ice maker. The ice maker may include a plurality of ice making units configured to produce ice having different shapes.

SUMMARY

Aspects of embodiments of the disclosure will be set forth in part in the description which follows and, in part, will be apparent from the description, or may be learned by practice of the presented embodiments.

According to an embodiment of the disclosure, a refrigerator may include an ice maker configured to produce ice; an ice bucket positionable under the ice maker and including a first position guide; and a pad mountable to the ice bucket and including a base, an inclined member, and a second position guide. The pad and the bucket may be configured so that, when the pad is being mounted to the ice bucket, the second position guide couples with the first position guide to guide positioning of the pad in the ice bucket so that, when the pad is mounted to the ice bucket, the base is in a front portion of the ice bucket and the inclined member is in a rear portion of the ice bucket and is inclined to the base, and, when the pad is mounted to the ice bucket and the ice bucket is positioned under the ice maker, ice produced by the ice maker falls into the ice bucket and is transferred by the inclined member to the base.

According to an embodiment of the disclosure, when the pad is mounted in the ice bucket, the first position guide and the second position guide are coupled to each other to maintain a position of the pad relative to the ice bucket.

According to an embodiment of the disclosure, one of the first position guide and the second position guide includes an insertion groove, and the other of the first position guide and the second position guide includes an insertion protrusion coupleable to the insertion groove.

According to an embodiment of the disclosure, the pad includes a side edge extending in a front to rear direction to form a periphery of the pad, and the second position guide is at a position biased in a direction from a midpoint of the side edge.

According to an embodiment of the disclosure, the pad includes a first side edge extending in a front to rear direction to form a periphery of the pad, and a second side edge opposite to the first side edge, wherein the second position guide is only on the first side edge.

According to an embodiment of the disclosure, the second position guide couples with the first position guide to guide positioning of the inclined member when the pad is being mounted to the ice bucket, and the ice bucket includes a third position guide, the pad further includes a fourth position guide, positioned relative to the third position guide to guide the base when the pad is being mounted in the ice bucket, one of the third position guide and the fourth position guide includes an interference groove recessed inward, and the other one of the third position guide and the fourth position guide includes an interference protrusion protruding to engage with the interference groove when the pad is being mounted in the ice bucket.

According to an embodiment of the disclosure, the second position guide is provided in the inclined member, and the fourth position guide is provided in the base.

According to an embodiment of the disclosure, the ice bucket includes an upper edge extending in a front to rear direction to form a periphery of the ice bucket, and a protruding member arranged at a position biased forward from a midpoint of the upper edge and protruding upward to interfere with a lower end of the ice maker to guide the ice bucket when the ice bucket is being positioned under the ice maker. According to an embodiment of the disclosure, the protruding member is forwardly spaced apart from the ice maker when the ice bucket is positioned under the ice maker.

According to an embodiment of the disclosure, the inclined member includes a guide member protruding from a center of the inclined member to guide the ice, falling from the ice maker, to a left side or a right side of the base.

According to an embodiment of the disclosure, the inclined member includes an extension protruding upwardly to be exposed to an outside of the ice bucket, and the second position guide is in the extension.

According to an embodiment of the disclosure, the ice maker is configured to produce spherical-shaped ice.

According to an embodiment of the disclosure, a refrigerator includes an ice maker including a first ice making unit configured to produce a first type of ice, and a second ice making unit configured to produce a second type of ice; a first ice bucket positionable under the first ice making unit to receive the first type of ice; a second ice bucket positionable under the second ice making unit to receive the second type of ice; a drawer in which the first ice bucket and the second ice bucket are mountable side by side, the drawer including: a rear wall having a mounting groove, a first interference member positioned at a first side of the mounting groove, a second interference member positioned at a second side, opposite to the first side, of the mounting groove, a first side wall bent from the first interference member so as to extend forward from the first interference member, and a second side wall bent from the second interference member so as to extend forward from the second interference member; and a pad mountable to the first ice bucket, the pad including: an outer edge extending in a front to rear direction to form a periphery of the pad and being adjacent to one of the first side wall and the second side wall of the drawer when the pad is mounted in the first ice bucket and the first ice bucket is normally mounted in the drawer, an inner edge adjacent to a center of the drawer when the pad is mounted to the first ice bucket and the first ice bucket is normally mounted in the drawer, and a protrusion extending backward and configured so that, when the pad is mounted to the first ice bucket and the first ice bucket is being normally mounted in the drawer, the protrusion becomes mounted in the mounting groove so as to guide normal positioning of the first ice bucket in the drawer, and so that, when the pad is mounted to the first ice bucket and the first ice bucket is being abnormally mounted in the drawer, the protrusion interferes with one of the first interference member and the second interference member so as to be lifted without becoming mounted in the mounting groove.

According to an embodiment of the disclosure, the first ice bucket, to which the pad is mounted, is provided so that the protrusion of the pad interferes with the one of the first interference member and the second interference member in response to the inner edge of the pad being arranged to face the one of the first side wall and the second side wall of the drawer.

According to an embodiment of the disclosure, the pad has a bottom surface inclined so that a rear portion of the bottom surface is higher than a front portion the bottom surface when the pad is mounted to the first ice bucket.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

Figure 1:
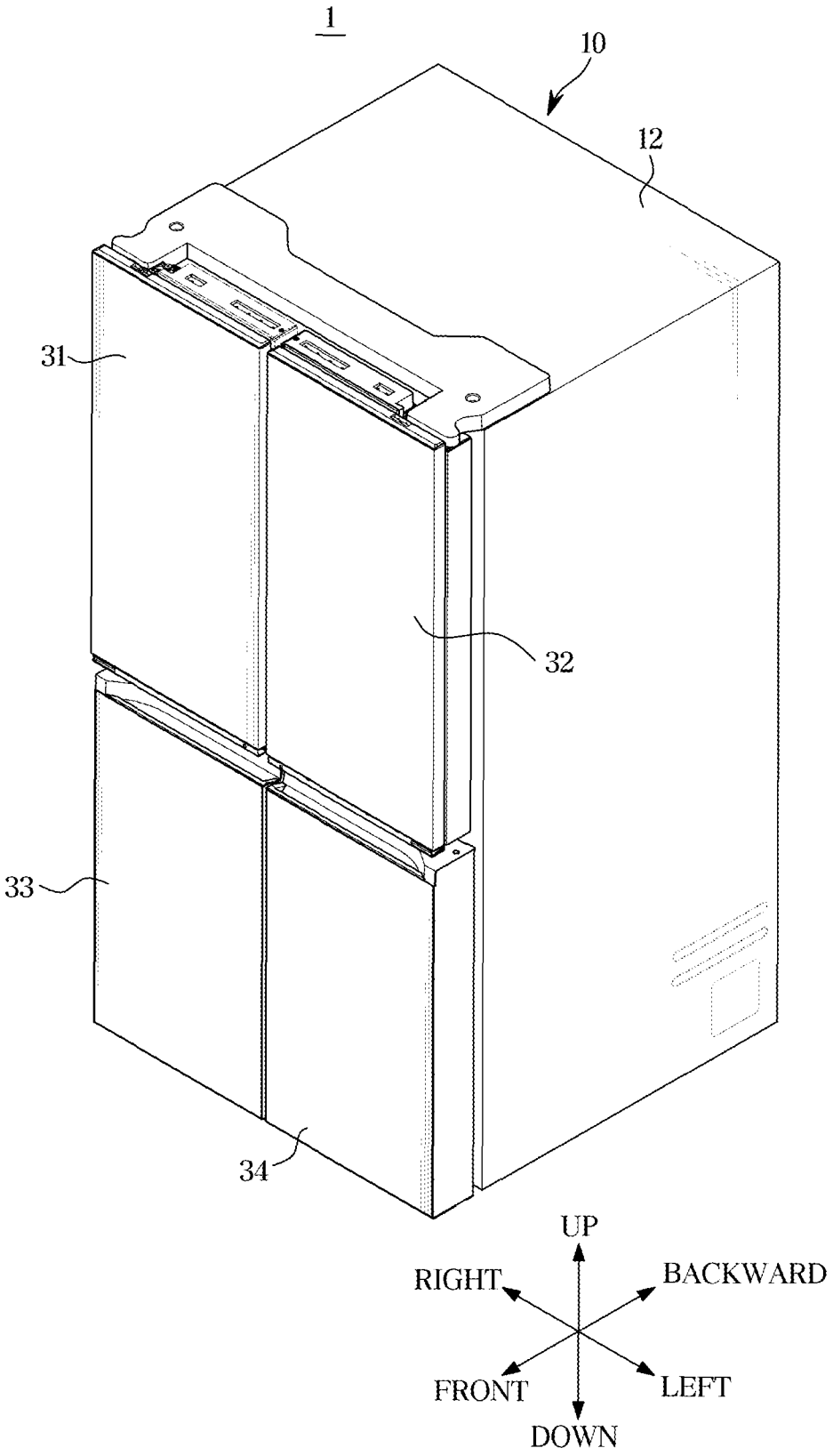
FIG. 1 is a perspective view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

It is another embodiment of the disclosure to provide a refrigerator including an ice-making assembly capable of intuitively providing an assembly direction in a front and rear direction.

It is another embodiment of the disclosure to provide a refrigerator including an ice-making assembly capable of intuitively providing an assembly direction in a left and right direction.

Additional embodiments of the disclosure will be set forth in part in the description which follows and, in part, will be obvious from the description, or may be learned by practice of the disclosure.

Various embodiments of the disclosure provide a refrigerator including an ice-making assembly capable of reducing an impact generated in response to ice falling from an ice maker to an ice bucket and capable of increasing an amount of ice stored in the ice bucket.

Reference will now be made in detail to embodiments of the disclosure, examples of which are illustrated in the accompanying drawings.

Figure 2:
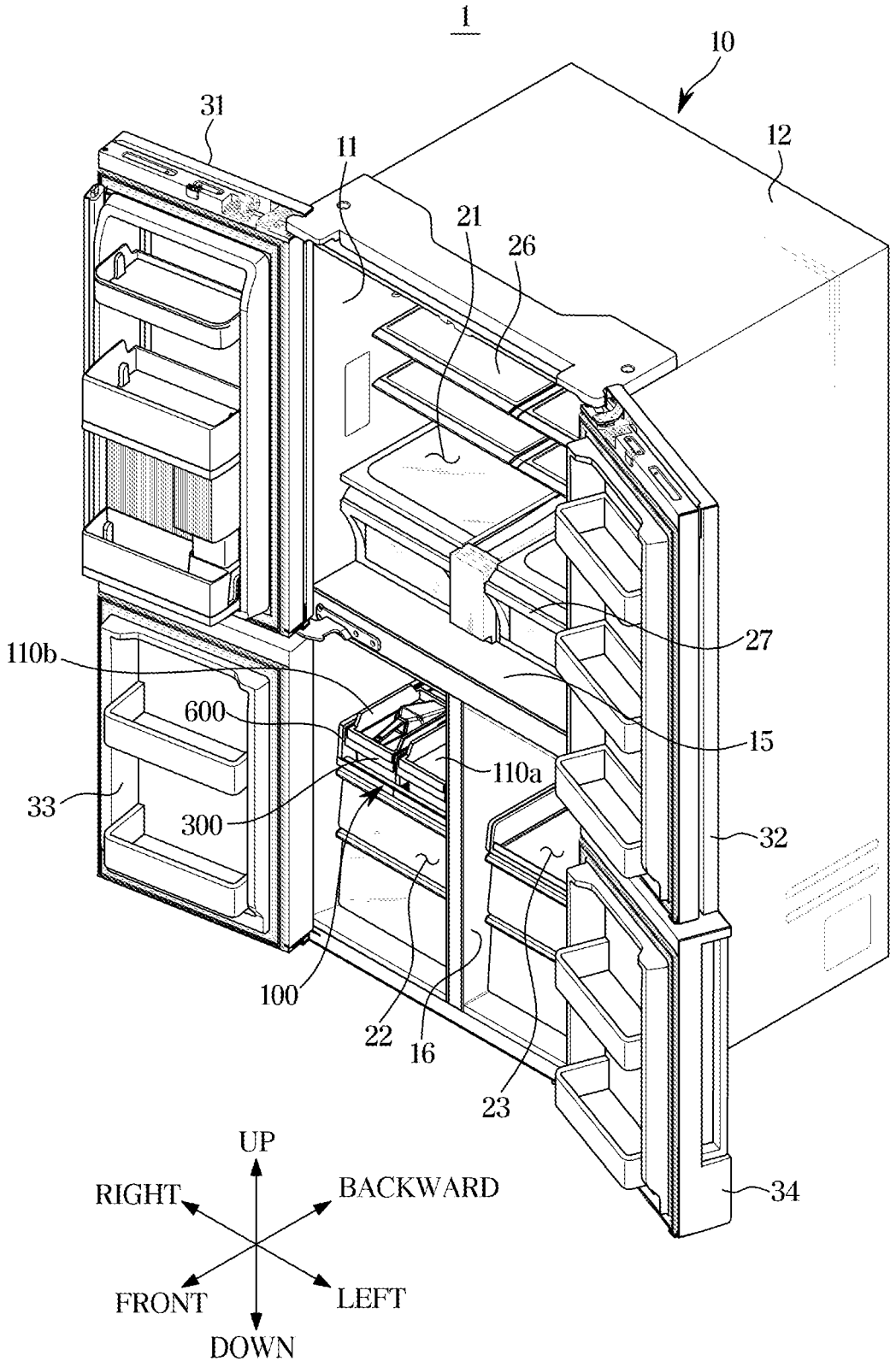
FIG. 2 is a view illustrating a state in which a door of the refrigerator of FIG. 1 is opened according to an embodiment of the disclosure.

FIG. 1 is a perspective view of a refrigerator according to an embodiment of the disclosure. FIG. 2 is a view illustrating a state in which a door of the refrigerator of FIG. 1 is opened.

Referring to FIGS. 1 and 2, the refrigerator 1 according to the disclosure may include a main body 10, a plurality of storage compartments 21, 22, and 23 arranged inside the main body 10, a plurality of doors 31, 32, 33, and 34 configured to open and close the plurality of storage compartments 21, 22, and 23, and a cold air supply device (not shown) configured to supply cold air to the plurality of storage compartments 21, 22, and 23.

The main body 10 may include an inner case 11 forming the storage compartments 21, 22, and 23, an outer case 12 coupled to an outside of the inner case 11 so as to form an appearance, and an insulating material (not shown) formed between the inner case 11 and the outer case 12 to insulate the storage compartments 21, 22, and 23.

The plurality of storage compartments 21, 22, and 23 may be divided into a plurality of spaces by a horizontal partition wall 15 and a vertical partition wall 16. The plurality of storage compartments 21, 22, and 23 may be divided into a first storage compartment 21 as an upper storage compartment, and a second storage compartment 22 and a third storage compartment 23 as a lower storage compartment by the horizontal partition wall 15. The lower storage compartment may be divided into the second storage compartment 22 and the third storage compartment 23 by the vertical partition wall 16.

The upper storage compartment (the first storage compartment 21) may be used as a refrigerating compartment. The lower storage compartment corresponding to the second storage compartment 22 and the third storage compartment 23 may be used as a freezing compartment. However, the division use of the plurality of storage compartments 21, 22, and 23 as described above is only one example, and is not limited thereto.

Hereinafter the first storage compartment 21 corresponding to the upper storage compartment is referred to as a refrigerating compartment, and the second storage compartment 22 and the third storage compartment 23 corresponding to the lower storage compartment are referred to as a freezing compartment.

Alternatively, unlike the drawing, the refrigerator 1 may be a side by side (SBS) type in which the storage compartment is divided into the left and right by the vertical partition wall 16, and a French door refrigerator (FDR) in which the storage compartment is divided into the upper refrigerating compartment and the lower freezing compartment by the horizontal partition wall 15.

A shelf 26 on which food is placed and a storage container 27 in which food is stored may be arranged inside the plurality of storage compartments 21, 22, and 23.

The cold air supply device may be configured to generate cold air using a refrigeration cycle of compressing, condensing, expanding, and evaporating a refrigerant, and configured to supply the generated cold air to the plurality of storage compartments 21, 22, and 23.

The refrigerating compartment 21 may be opened and closed by a pair of doors. The pair of doors may be rotatably coupled to the main body 10. The pair of doors may include a first door 31 and a second door 32.

An ice making assembly 100 may be arranged in the freezing compartment 22 of the refrigerator 1. The ice making assembly 100 may produce ice by using cold air in the freezing compartment. The ice making assembly 100 may be provided inside the second storage compartment 22.

The drawing illustrates that the ice making assembly 100 is arranged in the second storage compartment 22 that is the left freezing compartment as an example, the disclosure is not limited thereto. For example, the ice making assembly 100 may be arranged in the third storage compartment 23 that is the right freezing compartment.

The ice making assembly 100 may include an ice maker 200 (FIG. 3), an ice bucket 300, and a drawer 600. The ice bucket 300 may be arranged under the ice maker 200. The ice bucket 300 mounted on the drawer 600 may be drawn in and out from the front of the freezing compartment 22.

Figure 3:
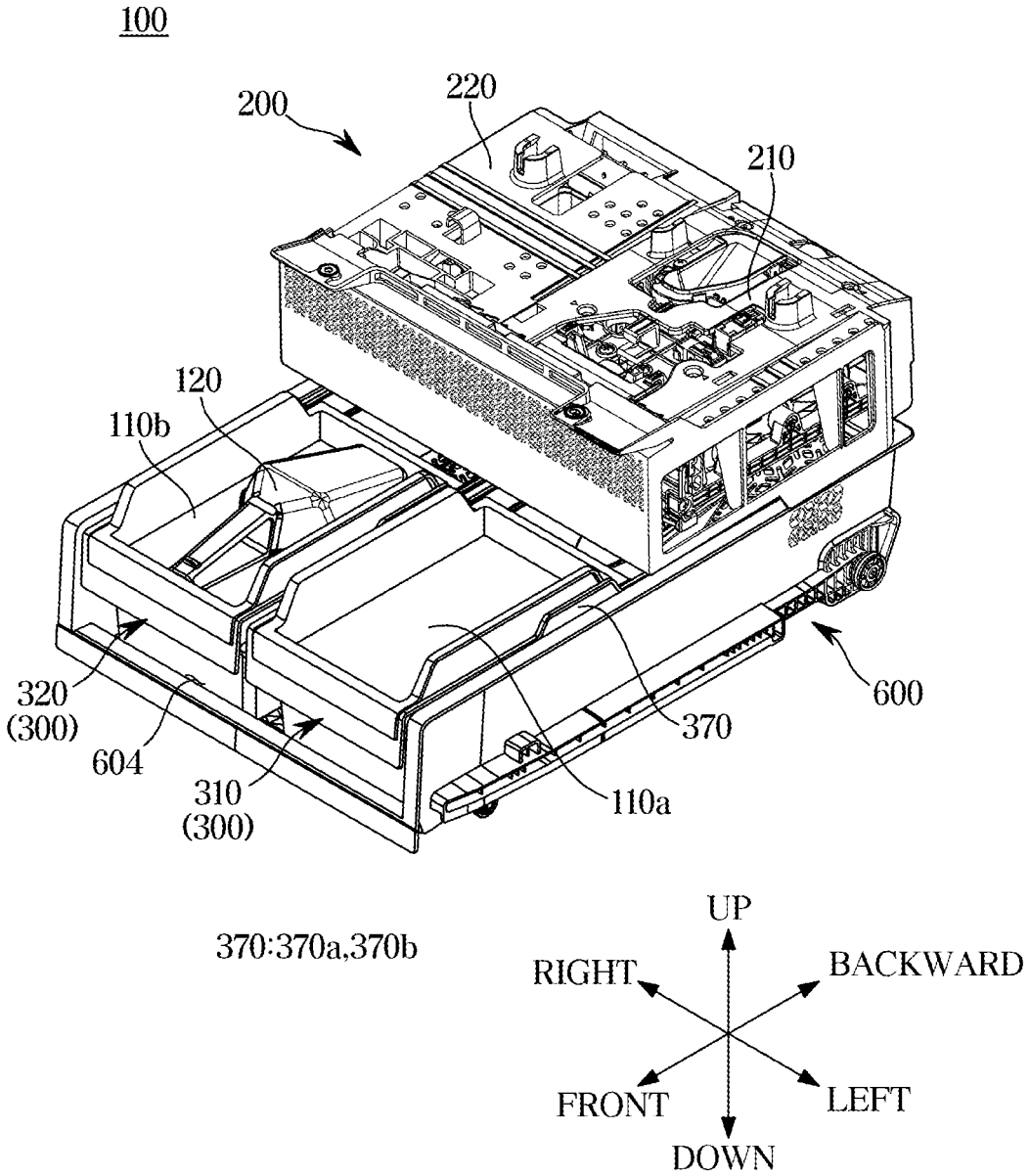
FIG. 3 is a front view of an ice making assembly according to an embodiment of the disclosure.
Figure 4:
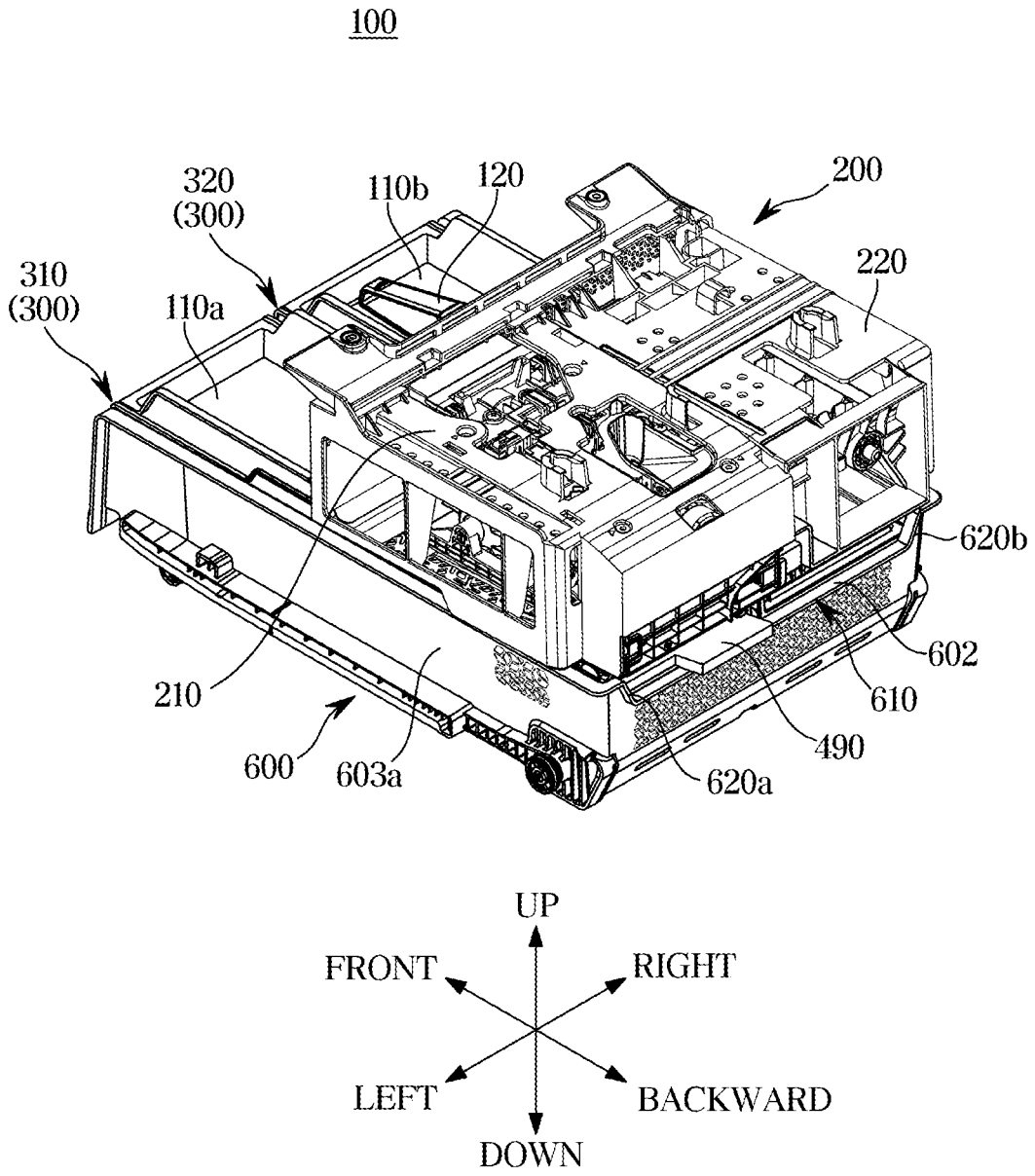
FIG. 4 is a rear view of the ice making assembly according to an embodiment of the disclosure.
Figure 5:
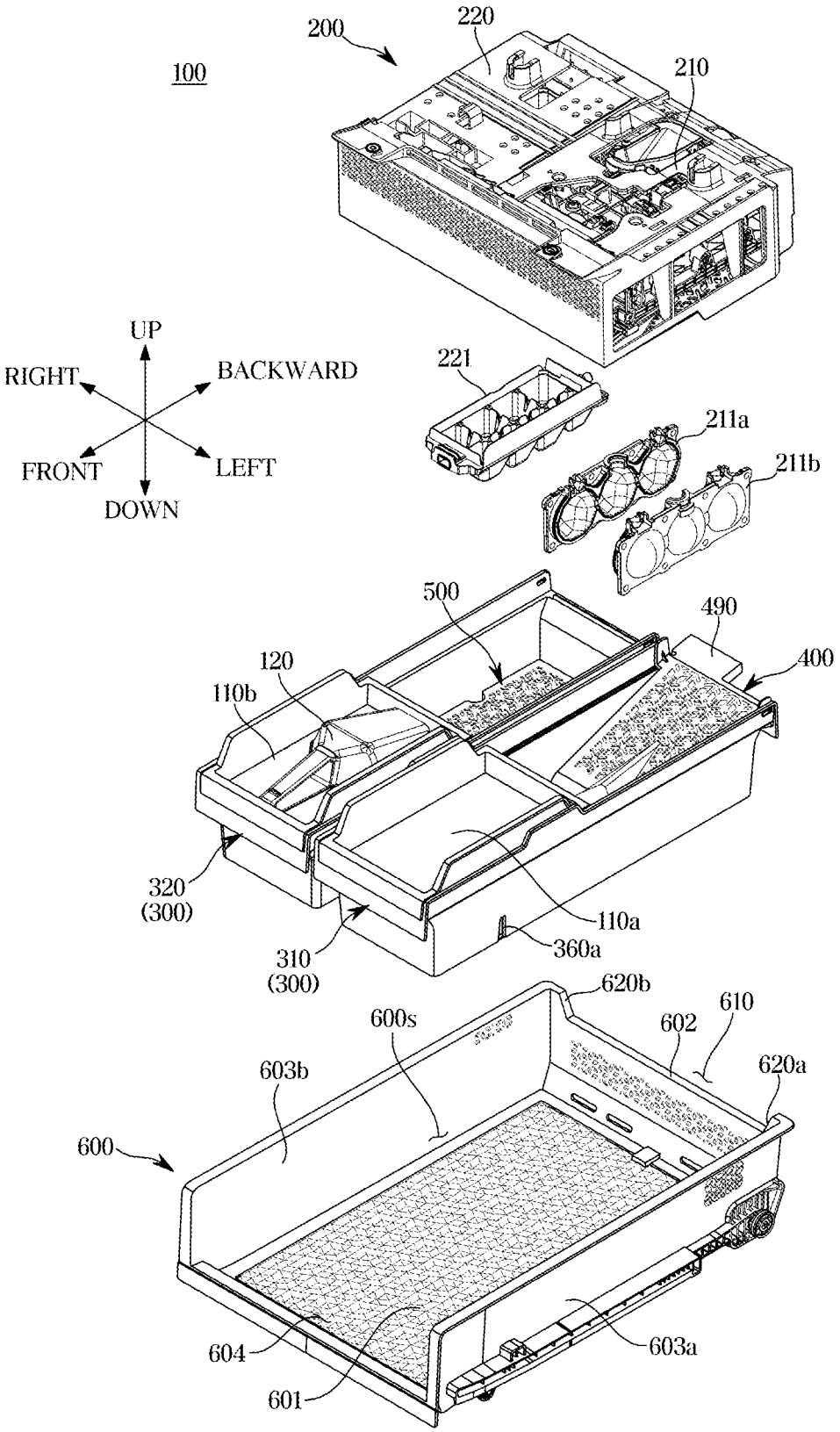
FIG. 5 is an exploded view of the ice making assembly according to an embodiment of the disclosure.
Figure 6:
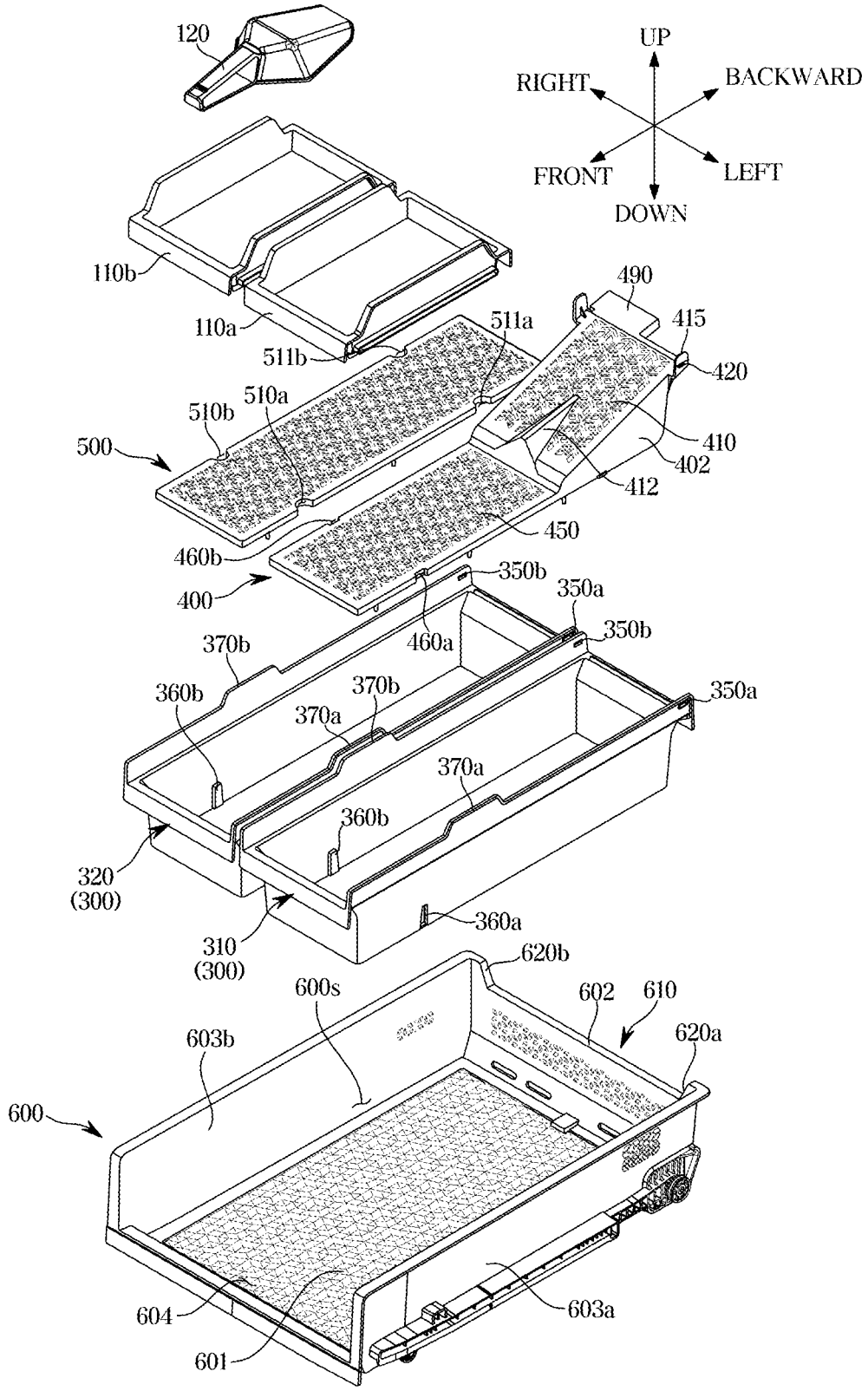
FIG. 6 is a view illustrating an expanded view of a drawer, ice buckets, pads and covers according to an embodiment of the disclosure.

FIG. 3 is a front view of an ice making assembly 100. FIG. 4 is a rear view of the ice making assembly 100. FIG. 5 is an exploded view of the ice making assembly 100. FIG. 6 is an expanded view of drawer 600, first ice bucket 310, second ice bucket 320, pads 400, 500 and covers 110*a*, 110*b* according to an embodiment of the disclosure.

The ice making assembly 100 may include the ice maker 200, the ice bucket 300, pads 400 and 500, the drawer 600, and covers 110*a* and 110*b*.

The ice maker 200 may be configured to produce ice. The ice maker 200 may include a first ice making unit 210 and a second ice making unit 220. The first ice making unit 210 may produce a first type of ice. The second ice making unit 220 may produce a second type of ice. The first ice making unit 210 and the second ice making unit 220 may be arranged side by side in the left and right direction.

Referring to FIG. 5, the first ice making unit 210 may include first trays 211*a* and 211*b*. The first trays 211*a* and 211*b* may include a spherical tray. The first ice making unit 210 may produce spherical-shaped ice. The second ice making unit 220 may include a second tray 221. In this drawing, it is illustrated that the first trays 211*a* and 211*b* include a spherical tray and the second tray 221 includes a hexagonal tray as an example, but the disclosure is not limited thereto. For example, the ice maker 200 may produce ice of various shapes including trays having different shapes.

The first type of ice and the second type of ice may be formed in different shapes. Accordingly, a user can select a desired type of ice from any one of the first ice making unit 210 and the second ice making unit 220.

The ice bucket 300 may receive the ice produced by the ice maker 200. Because the ice maker 200 includes the first ice making unit 210 and the second ice making unit 220, a plurality of ice buckets 300 may be provided to respectively store ice produced in different shapes.

The drawer 600 may receive the ice bucket 300. The ice bucket 300 may be positioned on a bottom wall 601 of the drawer 600. A rear side of the ice bucket 300 may be arranged to face a rear wall 602 of the drawer 600, and a front side of the ice bucket 300 may be arranged to face an opening 604 of the drawer 600.

The ice bucket 300 may include a first ice bucket 310 and a second ice bucket 320. The first ice bucket 310 may be arranged under the first ice making unit 210, and the second ice bucket 320 may be arranged under the second ice making unit 220. The first ice bucket 310 may be arranged to receive the first type of ice produced by the first ice making unit 210, and the second ice bucket 320 may be arranged to receive the second type of ice produced by the second ice making unit 220.

The first ice bucket 310 and the second ice bucket 320 may be arranged side by side on the drawer 600. A first pad 400 may be mounted inside the first ice bucket 310, and a second pad 500 may be mounted inside the second ice bucket 320. The first pad 400 may be formed to be inclined, and the second pad 500 may be formed to be horizontal.

The covers 110*a* and 110*b* may be mounted on an upper side of the ice bucket 300. A scoop 120 may be arranged on the covers 110*a* and 110*b*.

The drawer 600 may be provided to allow the ice bucket 300 to be mounted thereon. The ice bucket 300 may be mounted in an inner space 600*s* of the drawer 600. The drawer 600 may include the opening 604 formed in the front to allow the ice bucket 300 to be drawn in and out.

The drawer 600 may include the bottom wall 601, the rear wall 602, and side walls 603*a* and 603*b*. The bottom wall 601 may form a lower portion of the drawer 600 to allow the ice bucket 300 to be mounted thereon.

The sidewalls 603*a* and 603*b* may extend upwardly from the bottom wall 601. The sidewalls 603*a* and 603*b* may be formed on opposite surfaces of the drawer 600.

The rear wall 602 may extend upwardly from the bottom wall 601. The rear wall 602 may be formed in the rear portion of the drawer 600. The rear wall 602 may be bent and extend from the side walls 603*a* and 603*b*.

The rear wall 602 may include a mounting groove 610. The mounting groove 610 may be formed in an upper portion of the rear wall 602. The mounting groove 610 may be recessed downward from an upper end of the rear wall 602.

The rear wall 602 may include interference members 620*a* and 620*b*. The interference members 620*a* and 620*b* may be arranged on opposite sides of the mounting groove 610. The side walls 603*a* and 603*b* may be bent forward from the interference members 620*a* and 620*b*.

Figure 7:
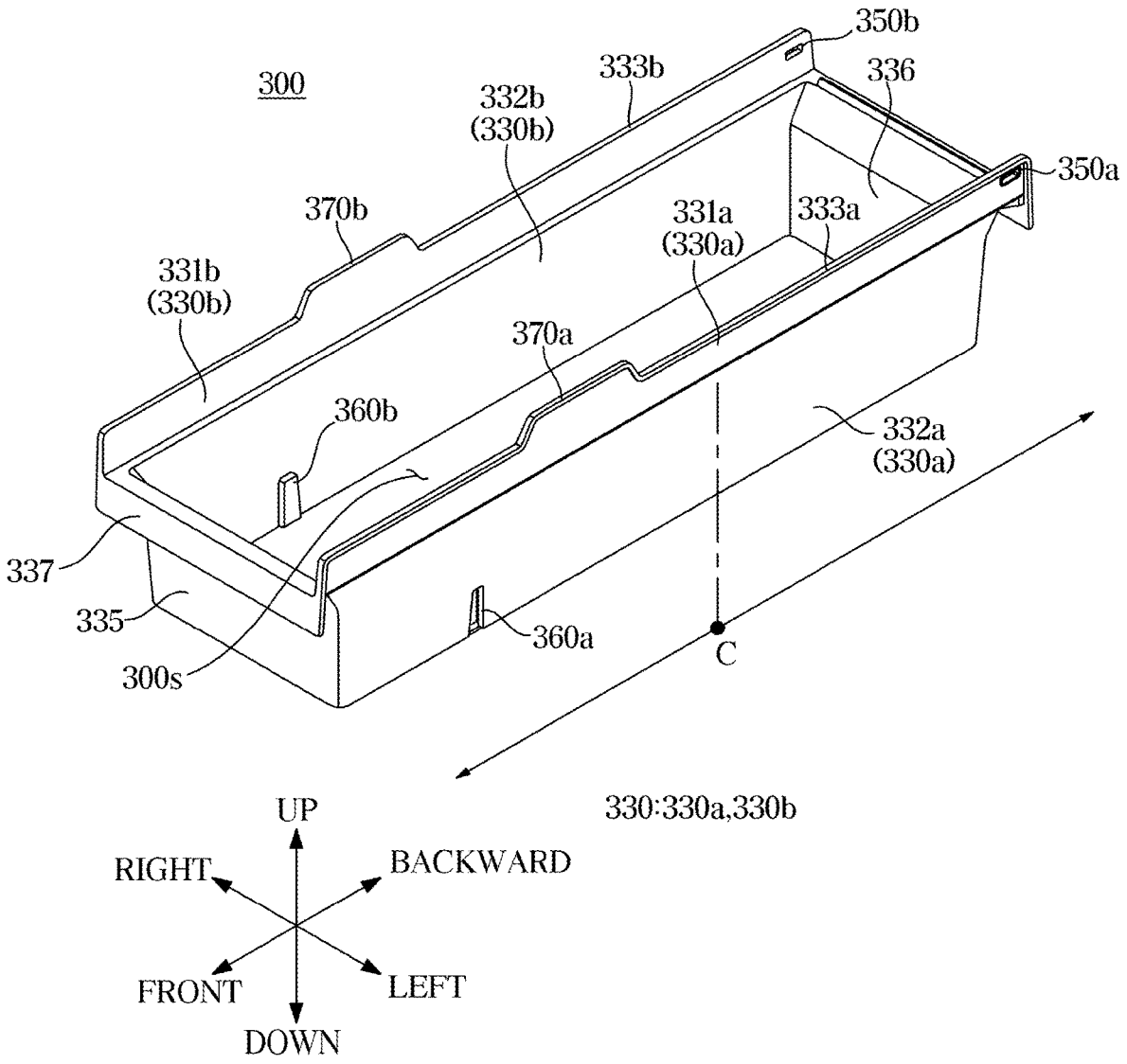
FIG. 7 is a perspective view of the ice bucket according to an embodiment of the disclosure.

FIG. 7 is a perspective view of the ice bucket.

The ice bucket 300 may be formed in a box shape. The ice bucket 300 may include sidewalls 330*a* and 330*b* extending in a front and rear direction. The ice bucket 300 may include a front wall 335 and a rear wall 336 extending in the left and right direction. The side walls 330*a* and 330*b* may be bent from the front wall 335 and the rear wall 336. The ice bucket 300 may include a rectangular parallelepiped shape in which a length of the side walls 330*a* and 330*b* is greater than a length of the front wall 335 and the rear wall 336.

The sidewalls 330*a* and 330*b* may include upper sidewalls 331*a* and 331*b* and lower sidewalls 332*a* and 332*b*. The upper sidewalls 331*a* and 331*b* may be provided on an upper end of the sidewalls 330*a* and 330*b*. The lower sidewalls 332*a* and 332*b* may be bent and extend from the front wall 335 and the rear wall 336. The upper sidewalls 331*a* and 331*b* may protrude from the lower sidewalls 332*a* and 332*b* toward the outside of the ice bucket 300. The upper sidewalls 331*a* and 331*b* may extend upwardly from the lower sidewalls 332*a* and 332*b*. The upper sidewalls 331*a* and 331*b* may form the upper end of the ice bucket 300.

The ice bucket 300 may include a handle wall 337. The handle wall 337 may be provided in a front portion of the ice bucket 300. The handle wall 337 may be provided on an upper side of the front wall 335.

The ice bucket 300 may include first position guides 350*a* and 350*b*. Together with a second position guide 420 provided on the first pad 400, the first position guides 350*a* and 350*b* may guide a front and rear arrangement in which the first pad 400 is mounted on the ice bucket 300. This will be described later.

The first position guides 350*a* and 350*b* may include an insertion groove or an insertion protrusion, but for convenience, in this drawing, the first position guides 350*a* and 350*b* will be described as including the insertion groove.

The insertion grooves 350*a* and 350*b* may be provided at a position biased in one direction from a midpoint C in the front and rear direction of the ice bucket 300. That is, the insertion grooves 350*a* and 350*b* may be provided eccentrically in the front portion or rear portion of the ice bucket 300.

The insertion grooves 350*a* and 350*b* may be provided in the rear portion of the ice bucket 300.

The insertion grooves 350*a* and 350*b* may be provided in the side portion of the ice bucket 300. The insertion grooves 350*a* and 350*b* may be provided on the sidewalls 330*a* and 330*b*.

The insertion grooves 350*a* and 350*b* may be provided in the upper portion of the ice bucket 300. The insertion grooves 350*a* and 350*b* may be provided on the upper sidewalls 331*a* and 331*b*.

The ice bucket 300 may include third position guides 360*a* and 360*b*. Together with fourth position guides 460*a* and 460*b* provided on the first pad 400, the third position guides 360*a* and 360*b* may guide the front and rear direction in which the first pad 400 is mounted on the ice bucket 300. This will be described later.

The third position guides 360*a* and 360*b* may include an interference groove or an interference protrusion, but for convenience, in this drawing, the third position guides 360*a* and 360*b* include the interference protrusion as an example.

The interference protrusions 360*a* and 360*b* may be provided at a position biased in one direction from the midpoint C in the front and rear direction of the ice bucket 300. That is, the interference protrusions 360*a* and 360*b* may be eccentrically provided in the front portion or rear portion of the ice bucket 300.

The interference protrusions 360*a* and 360*b* may be formed to protrude toward an inner space 300*s* of the ice bucket 300. That is, the interference protrusions 360*a* and 360*b* may protrude toward the pad mounted inside the ice bucket 300.

The interference protrusions 360*a* and 360*b* may be provided in the front portion of the ice bucket 300.

The interference protrusions 360*a* and 360*b* may be provided in the side portion of the ice bucket 300. The interference protrusions 360*a* and 360*b* may be provided on the sidewalls 330*a* and 330*b*.

The interference protrusions 360*a* and 360*b* may be provided in the lower portion of the ice bucket 300. The interference protrusions 360*a* and 360*b* may be provided on the lower sidewalls 332*a* and 332*b*. The interference protrusions 360*a* and 360*b* may be provided to extend upwardly from a lower end of the lower sidewalls 332*a* and 332*b*.

The drawing illustrates that the interference protrusions 360*a* and 360*b* are provided on the sidewalls 330*a* and 330*b* as an example, but the disclosure is not limited thereto. For example, the interference protrusions 360*a* and 360*b* may be formed on the front wall 335 and/or the rear wall 336.

The ice bucket 300 may include protruding members 370*a* and 370*b*. The protruding members 370*a* and 370*b* may be provided at a position biased forward from the midpoint C in the front and rear direction of the ice bucket 300. That is, the protruding members 370*a* and 370*b* may be provided eccentrically in the front portion of the ice bucket 300.

The protruding members 370*a* and 370*b* may be formed in the side portion of the ice bucket 300. The protruding members 370*a* and 370*b* may be provided on the sidewalls 330*a* and 330*b*.

The protruding members 370*a* and 370*b* may be formed in the upper portion of the ice bucket 300. The protruding members 370*a* and 370*b* may be provided on the upper sidewalls 331*a* and 331*b*. The protruding members 370*a* and 370*b* may be formed on the upper end of the upper sidewalls 331*a* and 331*b* to form the upper end of the ice bucket 300.

The protruding members 370*a* and 370*b* may be provided on upper edges 333*a* and 333*b* forming a periphery of the ice bucket 300 and forming the upper end of the upper sidewalls 331*a* and 331*b*. The protruding members 370*a* and 370*b* may protrude upward from the upper edges 333*a* and 333*b*.

The drawing illustrates that the protruding members 370*a* and 370*b* have a trapezoidal shape as an example, but the disclosure is not limited thereto. For example, the protruding members 370*a* and 370*b* may have a rectangular or triangular shape, and may be formed in any shape as long as the shape comes into contact with and interferes with a lower end 201 (see FIG. 20) of the ice maker 200.

Figure 8:
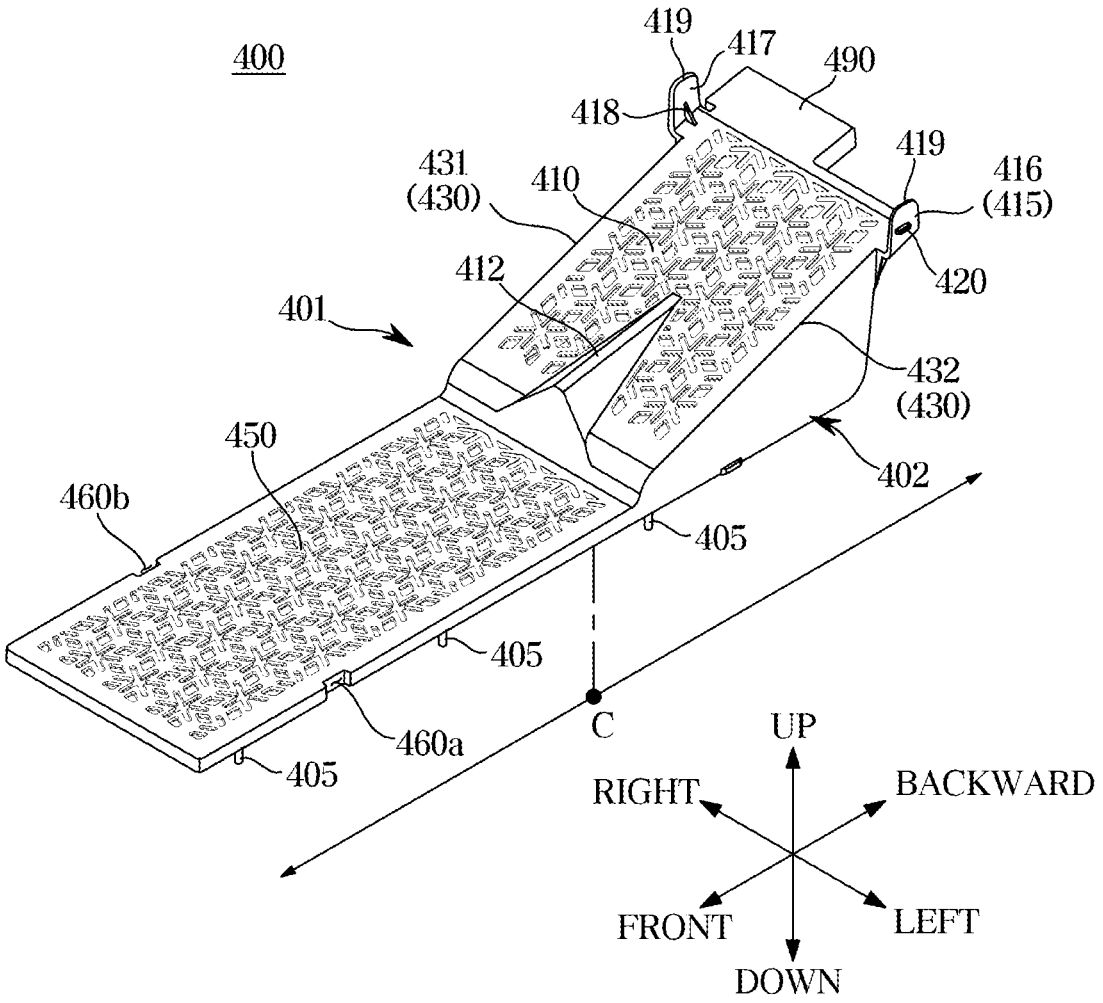
FIG. 8 is a perspective view of a first pad according to an embodiment of the disclosure.

FIG. 8 is a perspective view of a first pad.

The first pad 400 may include a bottom surface 401 and a side surface 402. The bottom surface 401 may be a surface in contact with ice falling from the ice maker 200. The bottom surface 401 may be provided to extend in the front and rear direction. The side surface 402 may be bent downward from the bottom surface 401. The side surface 402 may be opposed to the side wall 330 of the ice bucket 300 on which the first pad 400 is mounted.

The first pad 400 may include a side edge 430. The side edge 430 may be a point in which the bottom surface 401 and the side surface 402 are in contact with each other. The side edge 430 may extend in the front and rear direction to form a periphery of the first pad 400. The side edge 430 may include a first side edge 431 and a second side edge 432 provided on an opposite side of the first side edge 431.

The first pad 400 may include a spacing protrusion 405. The spacing protrusion 405 may be formed under the bottom surface 401. The spacing protrusion 405 may protrude downward. The first pad 400 may be arranged to be spaced apart from the bottom of the ice bucket 300 by a predetermined distance by the spacing protrusion 405.

The first pad 400 may be inclined. The bottom surface 401 may be inclined in such a way that a rear portion thereof is high and a front portion thereof is low.

The first pad 400 may include an inclined member 410 and a base 450. The inclined member 410 may be formed in a rear portion of the first pad 400 and arranged in the rear portion of the ice bucket 300. The base 450 may be formed in a front portion of the first pad 400, and may be arranged in the front portion of the ice bucket 300. The ice produced by the ice maker 200 may fall to the inclined member 410, and may be transferred to the front portion of the ice bucket 300 by the inclined member 410. Because the base 450 formed horizontally is arranged in front of the inclined member 450, it is possible to increase an amount of ice stored in the ice bucket 300.

The inclined member 410 may be inclined in such a way that a rear portion thereof is high and a front portion thereof is low. That is, the inclined member 410 may be inclined downward toward the front side. The base 450 may be formed horizontally.

Alternatively, the base 450 may be formed to be inclined. In the drawing, the base 450 is horizontally formed and the inclined member 410 is formed to be inclined as an example, but is not limited thereto. Alternatively, in response to a slope, in which the inclined member 410 is inclined downward toward the front side, being greater than a slope, in which the base 450 is inclined downward toward the front side, the base 450 may be inclined.

The base 450 may extend forward from the inclined member 410. The inclined member 410 and the base 450 may be integrally formed with each other.

The inclined member 410 and the base 450 may be provided to extend along the front and rear direction. A length in the front and rear direction of the inclined member 410 may be less than a length in the front and rear direction of the base 450.

The inclined member 410 may include a guide member 412. The guide member 412 may be provided to allow ice falling from the ice maker 200 to be transferred to the left and right sides of the base 450. The guide member 412 may be arranged at a center of the inclined member 410 in the left and right direction.

The guide member 412 may protrude upward. The guide member 412 may have a triangular pyramid shape.

The guide member 412 may be arranged in a front portion of the inclined member 410. A lower end of the guide member 412 may be connected to the base 450.

The inclined member 410 may include an extension 415. The extension 415 may have a plate shape. The extension 415 may be provided to protrude upward from the bottom surface 401. The extension 415 may be exposed to the outside of the ice bucket 300.

The extension 415 may be provided in the side portion of the bottom surface 401. The extension 415 may be provided on a periphery of the bottom surface 401. The extension 415 may be provided on a part of the periphery forming the left and right sides of the bottom surface 401.

The extension 415 may include an outer surface 416 and an inner surface 417. The outer surface 416 may face the sidewall 330 of the ice bucket 300 on which the first pad 400 is mounted. The inner surface 417 may be formed on an opposite side of the outer surface 416.

A reinforcing rib 418 provided to reinforce the extension 415 may be provided on the inner surface 417 of the extension 415.

The first pad 400 may include the second position guide 420. The second position guide 420 may guide the front and rear direction in which the first pad 400 is mounted on the ice bucket 300. Particularly, the second position guide 420 may guide the first pad 400 to allow the inclined member 410 to be arranged in the rear portion of the ice bucket 300 and to allow the base 450 to be arranged in the front portion of the ice bucket 300. This will be described later.

The second position guide 420 may include the insertion protrusion or the insertion groove. For convenience, in the drawing, the second position guide 420 will be described as an example including the insertion protrusion.

The insertion protrusion 420 may be provided at a position biased in one direction from a midpoint C in the front and rear direction of the first pad 400. The insertion protrusion 420 may be provided at a position biased in one direction from a midpoint C of the side edge 430. That is, the insertion protrusion 420 may be provided eccentrically in the front or rear portion of the first pad 400.

The insertion protrusion 420 may be provided in the rear portion of the first pad 400. The insertion protrusion 420 may be provided in the inclined member 410.

The insertion protrusion 420 may be provided in the side portion of the first pad 400. The insertion protrusion 420 may be provided to protrude toward the outside of the first pad 400. That is, the insertion protrusion 420 may be provided to protrude toward the ice bucket 300 on which the first pad 400 is mounted.

The insertion protrusion 420 may be provided on the extension 415. The insertion protrusion 420 may be provided on the outer surface 417 of the extension 415. The extension 415 may include a handle 419 provided on the upper portion of the insertion protrusion 420. The handle 419 may be arranged to protrude upward from the upper end of the ice bucket 300 on which the first pad 400 is mounted.

The drawing illustrates that the insertion protrusion 420 is formed plurality and arranged in all of the first side edge 431 and the second side edge 432, but is not limited thereto. For example, the insertion protrusion 420 may be provided only on the first side edge 431.

The first pad 400 may include the fourth position guides 460*a* and 460*b*. The fourth position guides 460*a* and 460*b* may guide the front and rear direction in which the first pad 400 is mounted on the ice bucket 300. Particularly, the fourth position guides 460*a* and 460*b* may guide the first pad 400 to allow the inclined member 410 to be arranged in the rear portion of the ice bucket 300 and to allow the base 450 to be arranged in the front portion of the ice bucket 300. This will be described later The fourth position guides 460*a* and 460*b* may include the interference protrusion or the interference groove. For convenience, in the drawing, the fourth position guides 460*a* and 460*b* will be described as an example including the interference groove.

The interference grooves 460*a* and 460*b* may be provided at a position biased in one direction from the midpoint C in the front and rear direction of the first pad 400. The interference grooves 460*a* and 460*b* may be provided at a position biased in one direction from the midpoint C of the second side edge 432. That is, the interference grooves 460*a* and 460*b* may be provided eccentrically in the front portion or rear portion of the first pad 400.

The interference grooves 460*a* and 460*b* may be provided in front portion of the first pad 400. The interference grooves 460*a* and 460*b* may be provided in the base 450.

The interference grooves 460*a* and 460*b* may be provided in the side portion of the first pad 400. The interference grooves 460*a* and 460*b* may be recessed toward the inside of the first pad 400.

The first pad 400 may include a protrusion 490. The protrusion 490 may be provided in the rear portion of the inclined member 410. The protrusion 490 may include a plate shape extending toward the rear side. This will be described later.

Figure 9:
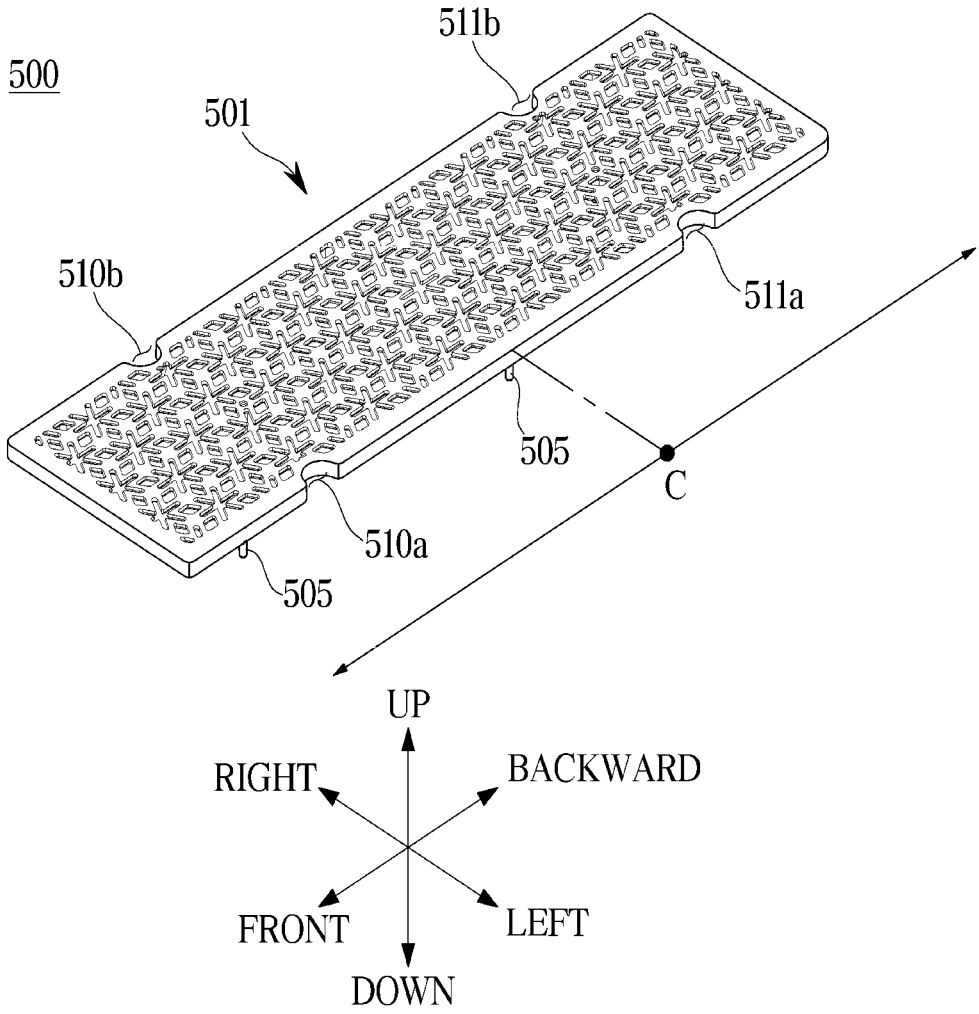
FIG. 9 is a perspective view of a second pad according to an embodiment of the disclosure.

FIG. 9 is a perspective view of a second pad.

The second pad 500 may have a horizontal plate shape. The second pad 500 may include a bottom surface 501 and a side surface. The bottom surface 501 of the second pad 500 may be provided horizontally.

The second pad 500 may include a spacing protrusion 505. The spacing protrusion 505 may be formed under the bottom surface 501. The spacing protrusion 505 may protrude downward. The second pad 500 may be arranged to be spaced apart from the bottom of the ice bucket 300 by a predetermined distance by the spacing protrusion 505.

The second pad may include a pair of symmetrical grooves 510*a*/511*a* and 510*b*/511*b*. The pair of symmetrical grooves 510*a*/511*a* and 510*b*/511*b* may be formed to be spaced apart from each other at the same distance based on the middle point C in the front and rear direction of the second pad 500. That is, the pair of symmetrical grooves 510*a*/511*a* and 510*b*/511*b* may be formed symmetrically with respect to the midpoint C.

The pair of symmetrical grooves 510*a*/511*a* and 510*b*/511*b* may be recessed toward the inside of the second pad 500.

Figure 10:
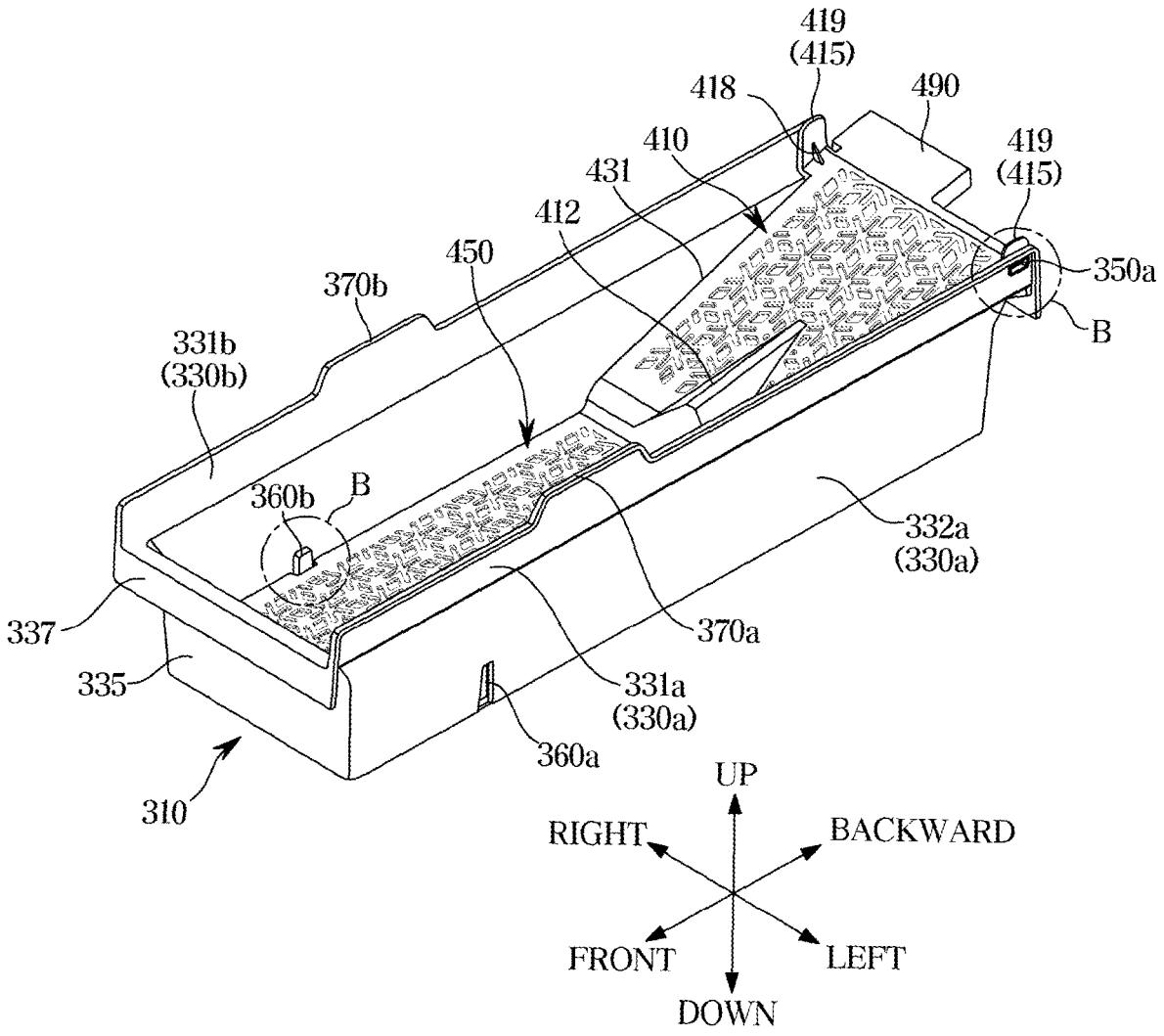
FIG. 10 is a perspective view illustrating a state in which the first pad is mounted inside the ice bucket according to an embodiment of the disclosure.
Figure 11:
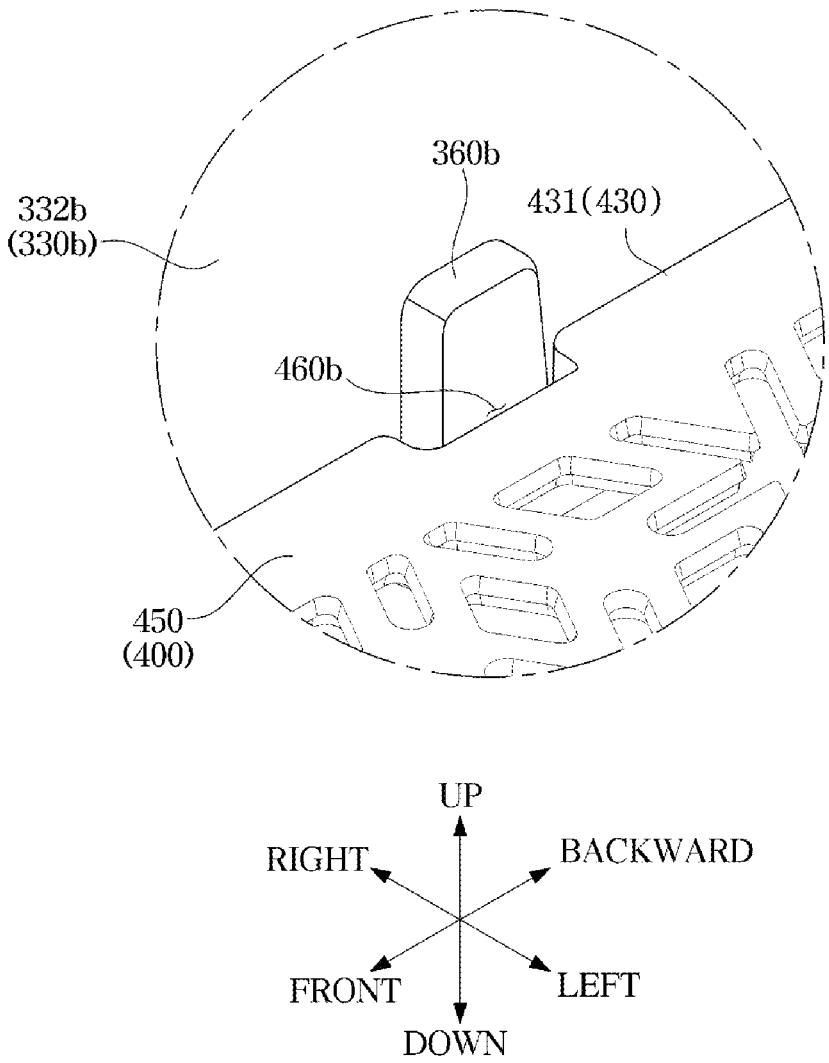
FIG. 11 is an enlarged view of an interference protrusion and an interference groove according to an embodiment of the disclosure.
Figure 12:
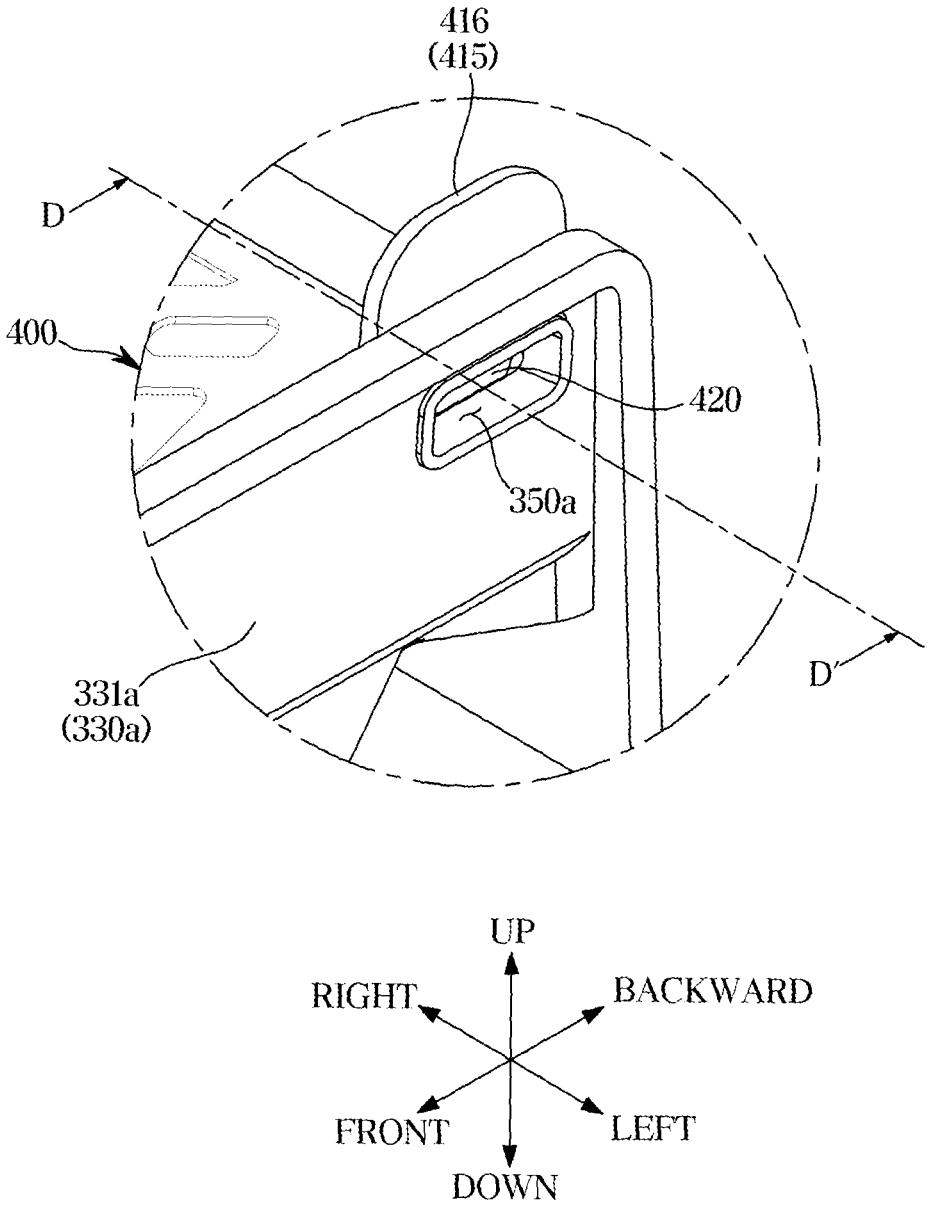
FIG. 12 is an enlarged view of an insertion protrusion and an insertion groove according to an embodiment of the disclosure.
Figure 13:
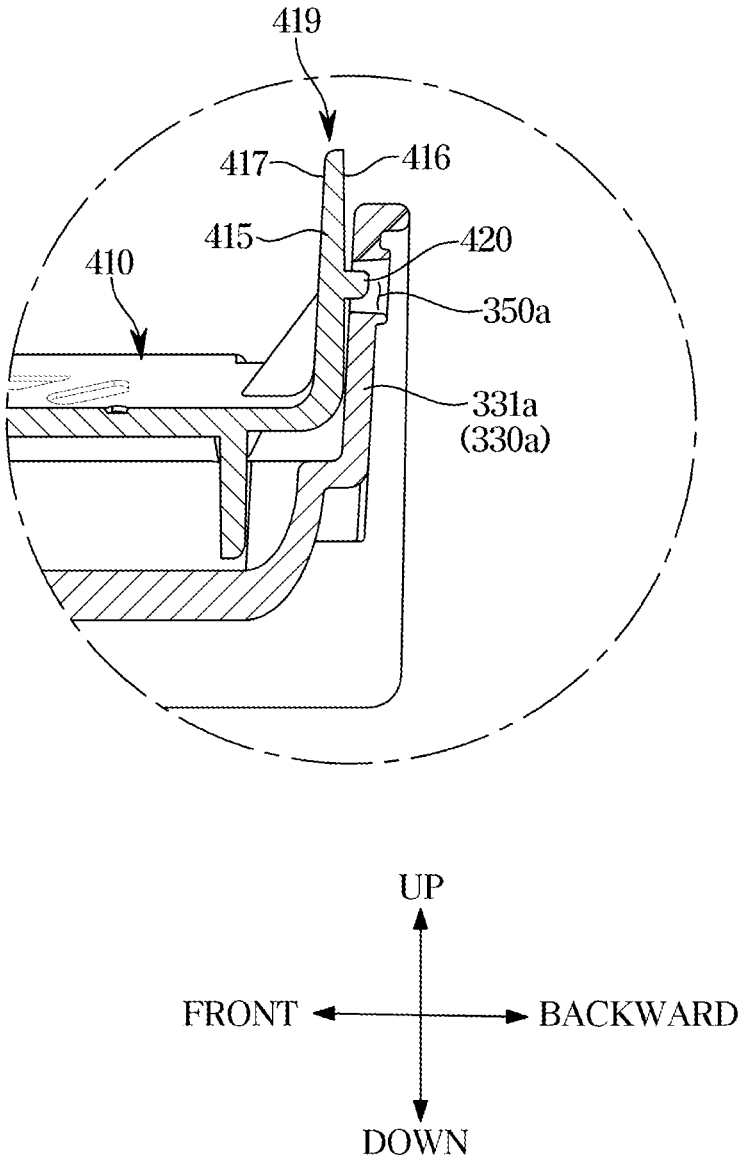
FIG. 13 is a cross-sectional view of FIG. 12 according to an embodiment of the disclosure.
Figure 14:
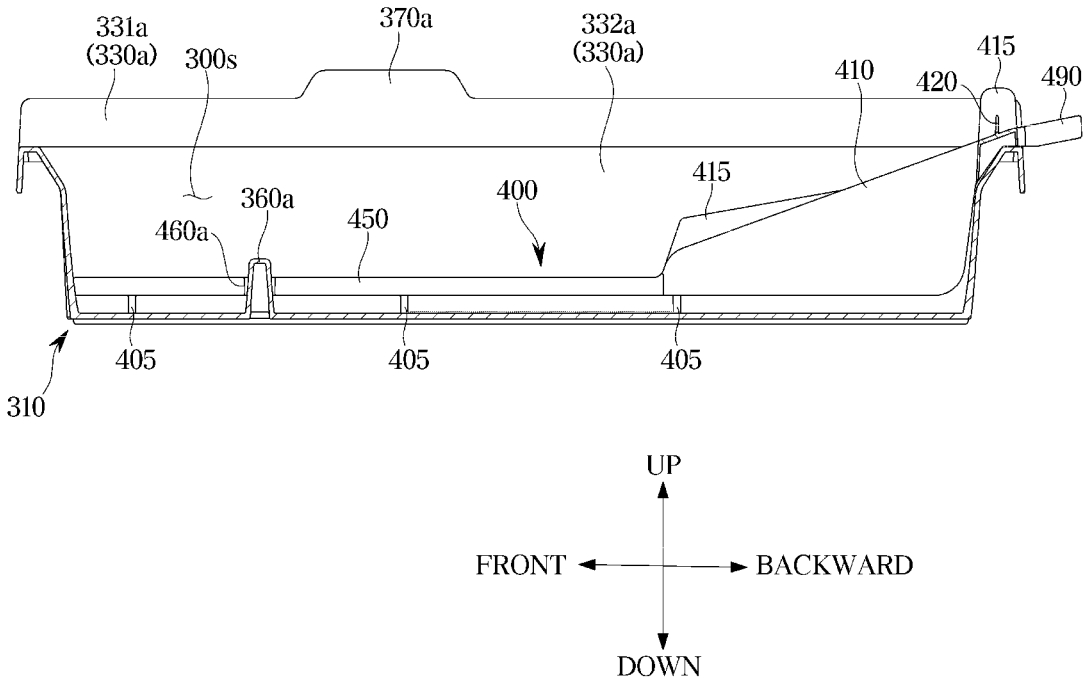
FIG. 14 is a cross-sectional view illustrating a state in which the first pad is arranged normally inside the ice bucket according to an embodiment of the disclosure.
Figure 15:
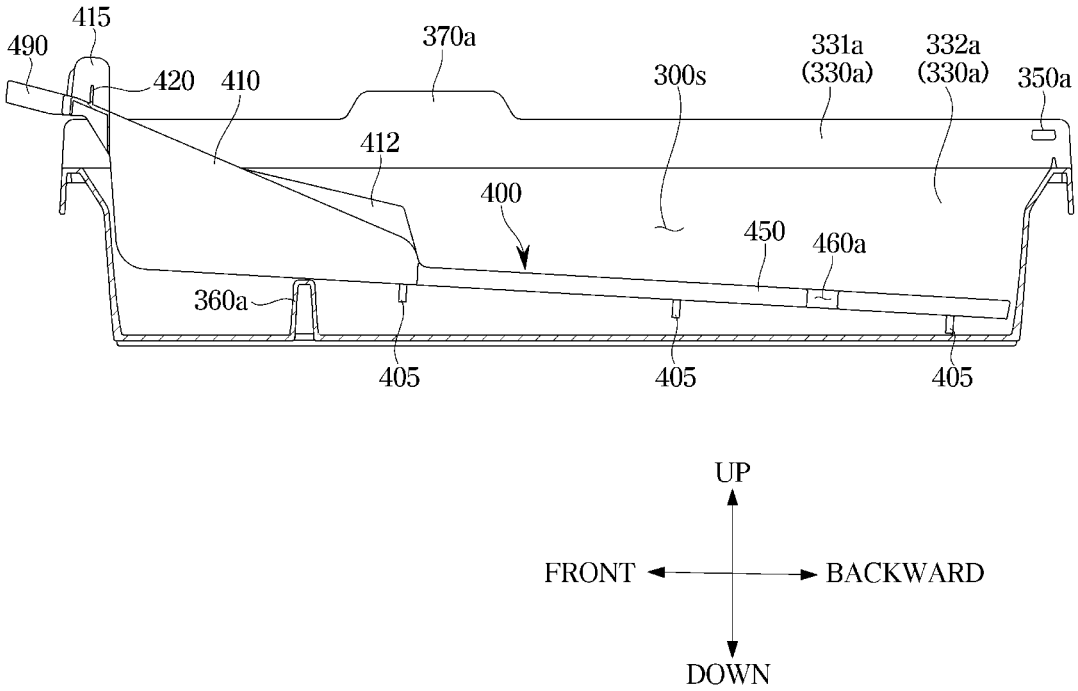
FIG. 15 is a cross-sectional view illustrating a state in which the first pad is arranged abnormally inside the ice bucket according to an embodiment of the disclosure.

FIG. 10 is a perspective view illustrating a state in which the first pad is mounted inside the ice bucket. FIG. 11 is an enlarged view of an interference protrusion and an interference groove. FIG. 12 is an enlarged view of an insertion protrusion and an insertion groove. FIG. 13 is a cross-sectional view of FIG. 12. FIG. 14 is a cross-sectional view illustrating a state in which the first pad is arranged normally inside the ice bucket. FIG. 15 is a cross-sectional view illustrating a state in which the first pad is arranged abnormally inside the ice bucket.

The first pad 400 may be mounted inside the ice bucket 300. The first pad 400 may be mounted in such a way that the inclined member 410 is arranged in the rear portion of the ice bucket 300 and the base 450 is arranged in the front portion of the ice bucket 300.

The insertion protrusion 420 of the first pad 400 may be inserted into the insertion grooves 350*a* and 350*b* of the ice bucket 300. That is, in a state in which the first pad 400 is assembled normally to the ice bucket 300, the insertion protrusion 420 may be inserted into the insertion grooves 350*a* and 350*b* formed in the side wall 330*a* of the ice bucket 300, and thus the first pad 400 may be mounted inside the ice bucket 300. Conversely, in a state in which the first pad 400 is assembled abnormally to the ice bucket 300, that is, the inclined member 410 is arranged in the front portion of the ice bucket 300 and the base 450 is arranged in the rear portion of the ice bucket 300, the insertion protrusion 420 and the sidewall 330*a* of the ice bucket 300 may interfere with each other and thus the first pad 400 may not be mounted inside the ice bucket 300. Accordingly, with the configuration of the insertion protrusion 420 and the insertion grooves 350*a* and 350*b*, a user can intuitively recognize an assembly direction of the first pad 400 in the front and rear direction.

In response to the insertion protrusion 420 being coupled to the insertion grooves 350*a* and 350*b*, the first pad 400 may be stably fixed to the ice bucket 300. It is possible to prevent the first pad 400 from being separated from the ice bucket 300.

Because the handle 419 protrudes from the upper end of the ice bucket 300, a user can easily separate the first pad 400 from the ice bucket 300 by gripping the handle 419.

The interference protrusions 360*a* and 360*b* of the ice bucket 300 may be coupled to the interference grooves 460*a* and 460*b* of the first pad 400. That is, in the state in which the first pad 400 is assembled normally to the ice bucket 300, the interference protrusions 360*a* and 360*b* may be coupled to the interference grooves 460*a* and 460*b*, and thus the first pad 400 may be mounted inside the ice bucket 300. On the contrary, in a state in which the first pad 400 is assembled abnormally to the ice bucket 300, that is, the inclined member 410 is arranged in the front portion of the ice bucket 300 and the base 450 is arranged in the rear portion of the ice bucket 300, the side surface 402 of the first pad 400 and the interference protrusions 360*a* and 360*b* of the ice bucket 300 may interfere with each other, and thus the first pad 400 may not be mounted inside the ice bucket 300. Therefore, with the configuration of the interference grooves 460*a* and 460*b* and the interference protrusions 360*a* and 360*b*, a user can intuitively recognize the assembly direction of the first pad 400 in the front and rear direction.

Meanwhile, the drawing illustrates that the first pad 400 includes the insertion protrusion 420 and the ice bucket 300 includes the insertion grooves 350*a* and 350*b* as an example, but the disclosure is not limited thereto. Alternatively, the first pad 400 may include the insertion groove, and the ice bucket 300 may include the insertion protrusion.

Further, the drawing illustrates that the first pad 400 includes the interference grooves 460*a* and 460*b* and the ice bucket 300 includes the interference protrusions 360*a* and 360*b* as an example, but the disclosure is not limited thereto. Alternatively, the first pad 400 may include the interference protrusion, and the ice bucket 300 may include the interference groove.

Figure 16:
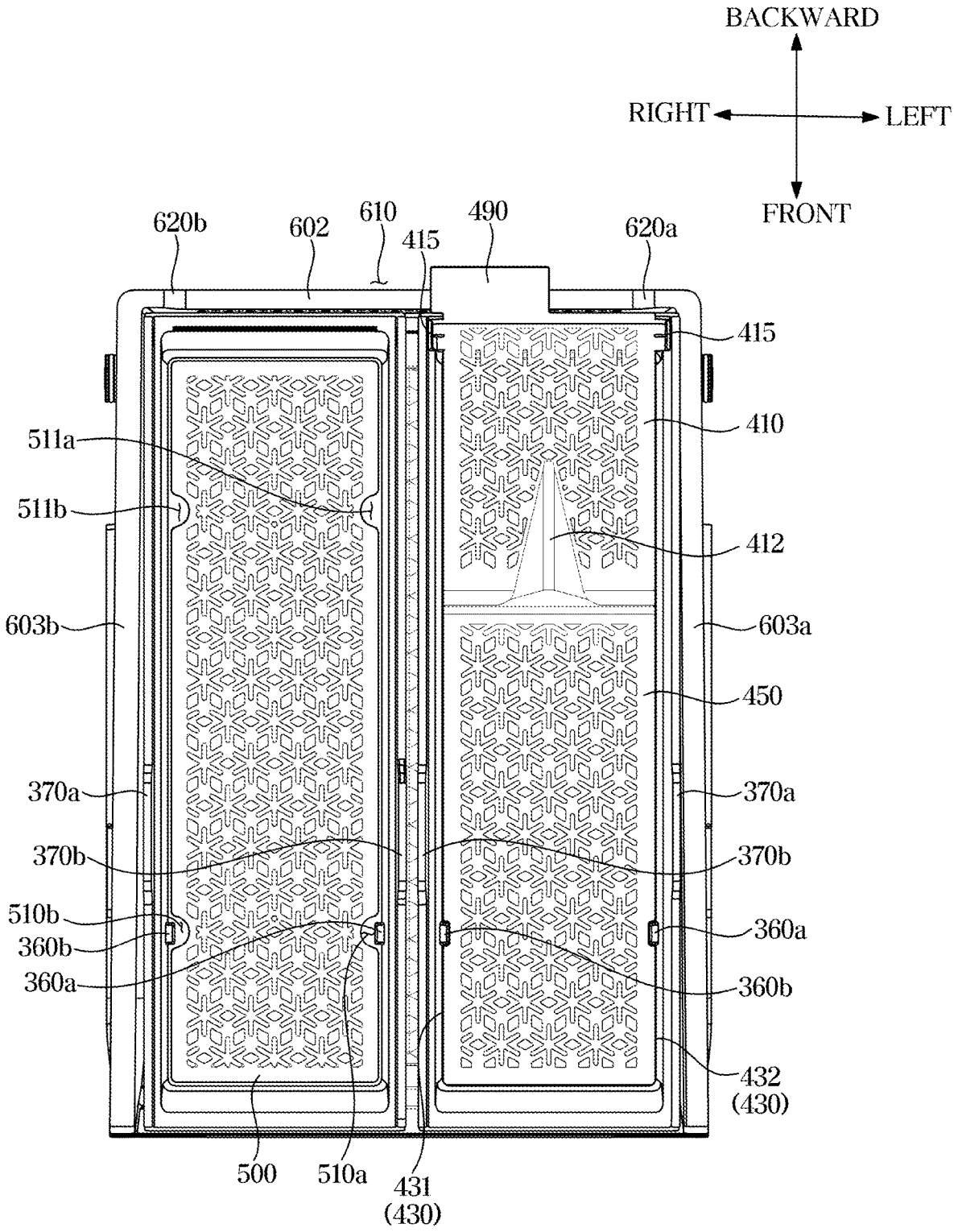
FIG. 16 is a top view illustrating a state in which a first ice bucket and a second ice bucket are arranged normally in the drawer according to an embodiment of the disclosure.
Figure 17:
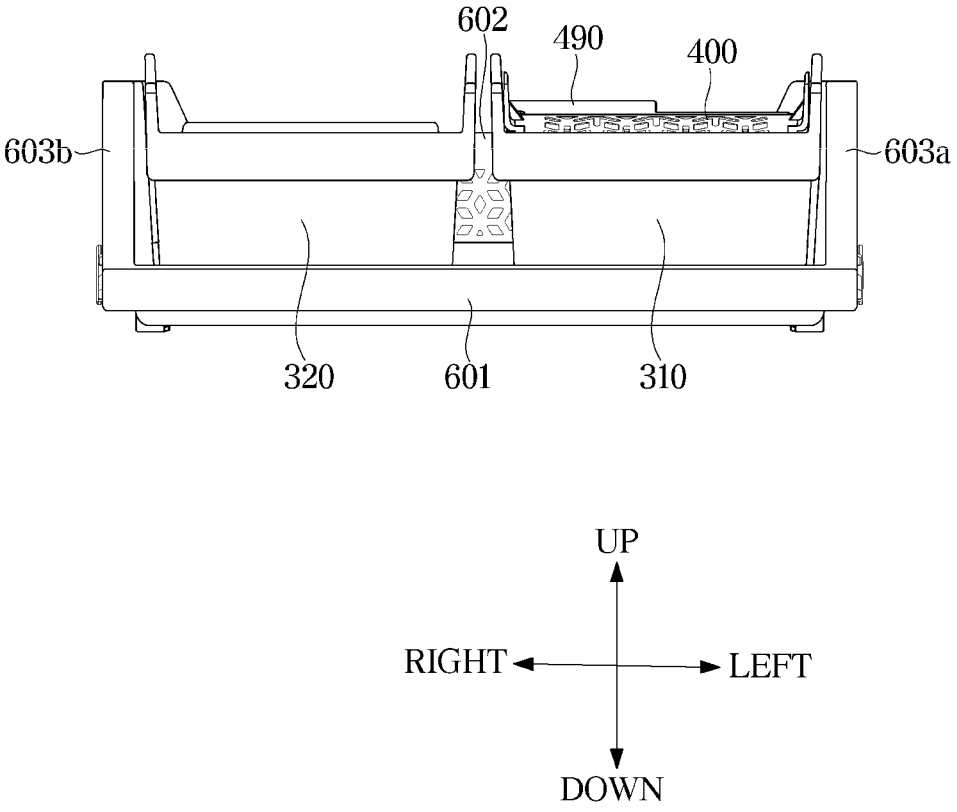
FIG. 17 is a front view of FIG. 16 according to an embodiment of the disclosure.
Figure 18:
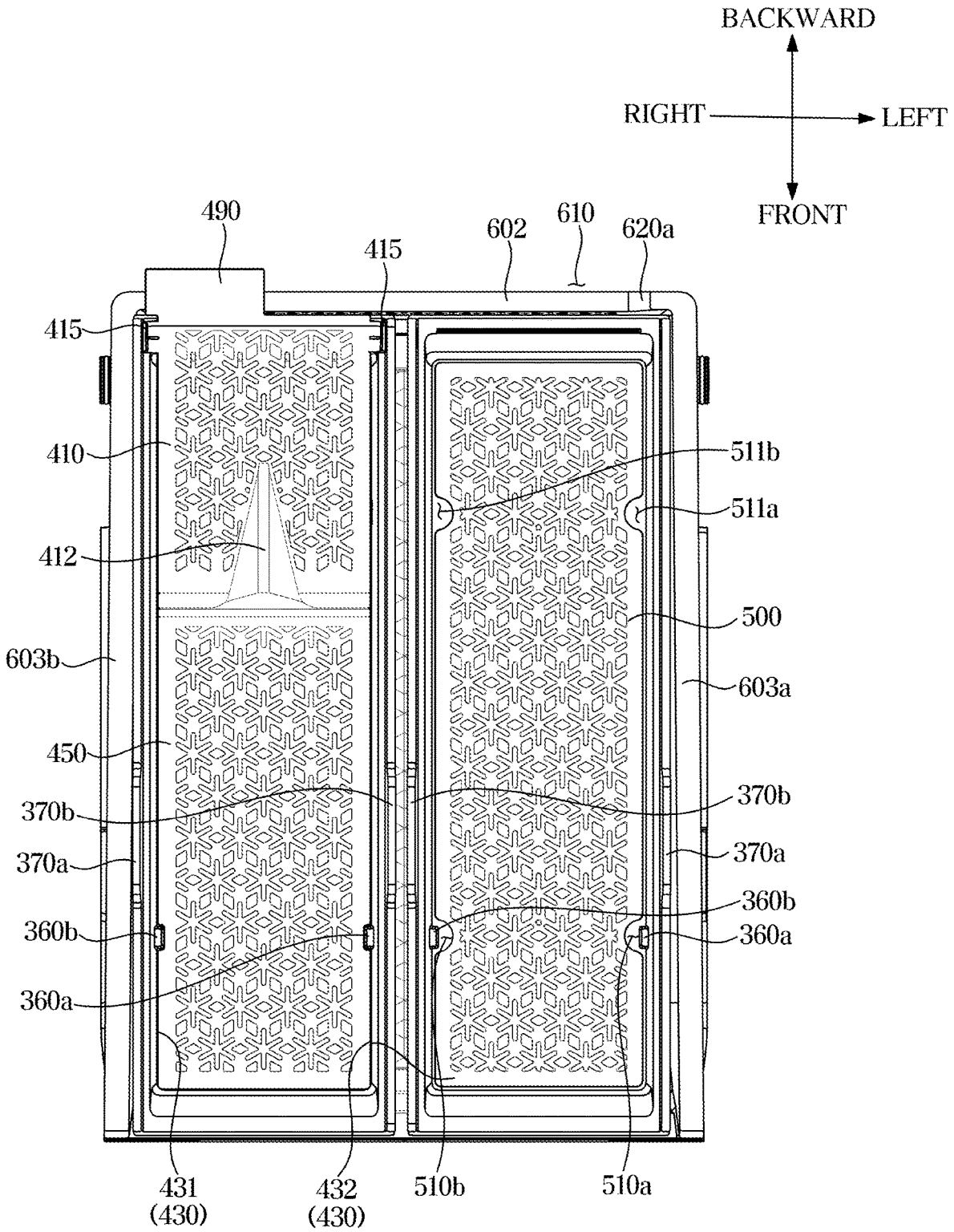
FIG. 18 is a top view illustrating a state in which the first ice bucket and the second ice bucket are arranged abnormally in the drawer according to an embodiment of the disclosure.
Figure 19:
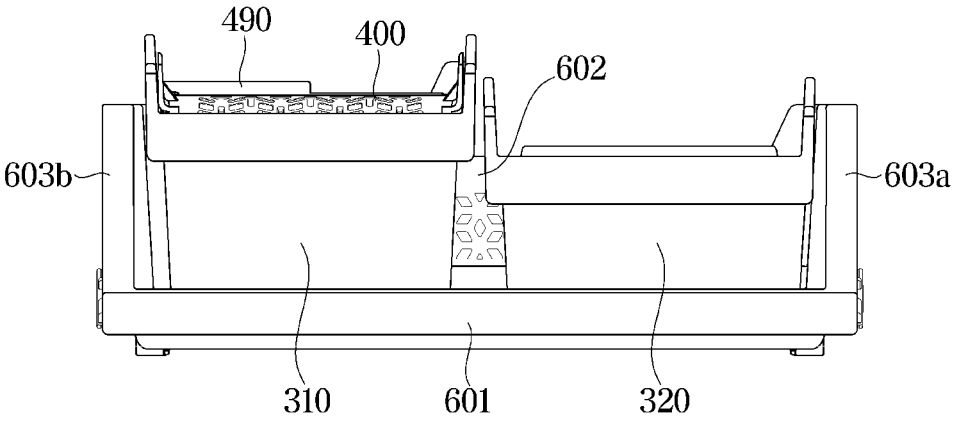
FIG. 19 is a front view of FIG. 18 according to an embodiment of the disclosure.

FIG. 16 is a top view illustrating a state in which a first ice bucket and a second ice bucket are arranged normally in the drawer. FIG. 17 is a front view of FIG. 16. FIG. 18 is a top view illustrating a state in which the first ice bucket and the second ice bucket are arranged abnormally in the drawer. FIG. 19 is a front view of FIG. 18.

Referring to FIG. 5, the first ice bucket 310, on which the first pad 400 including the inclined member 410 is mounted, may be arranged under the first ice making unit 210 provided to produce spherical-shaped ice. When it is assumed that a position, in which the first ice making unit 210 is arranged in the ice maker 200, is the left side, the first ice bucket 310 may be arranged on the left side in the drawer 600.

Referring to FIG. 16, the side edge 430 of the first pad 400 may include the outer edge (second side) 432 adjacent to the sidewall 330 of the drawer 600, and the inner (first side) edge 431 adjacent to the center of the drawer 600. The outer (second side) edge 432 and the inner (first side) edge 431 may be opposite to each other.

The protrusion 490 of the first pad 400 may extend backward from the inner edge 431 of the first pad 400. The protrusion 490 may be mounted in the mounting groove 610 of the rear wall 602 of the drawer 600. The protrusion 490 may protrude to the rear side of the ice bucket 300 and penetrate the rear wall 602 of the drawer 600.

Therefore, in a state in which the first ice bucket 310 is arranged normally on the left side in the drawer 600, the protrusion 490 may pass through the mounting groove 610 and be mounted on the rear wall 602. Accordingly, referring to FIG. 17, the first ice bucket 310 on which the first pad 400 is mounted may be stably mounted on the drawer 600. Particularly, the bottom surface of the first ice bucket 310 may be maintained in a state of being in contact with the bottom wall 601 of the drawer 600.

Referring to FIG. 18, on the contrary, in a state in which the first pad 400 is arranged abnormally in the drawer 600, that is, the first ice bucket 310, on which the first pad 400 is mounted, is arranged on the right side in the drawer 600 so as to be arranged under the second ice making unit 220, the protrusion 490 of the first pad 400 may interfere with the interference members 620*a* and 620*b* of the rear wall 602 of the drawer 600. That is, the protrusion 490 may interfere with the interference members 620*a* and 620*b*, and thus the protrusion 490 may be lifted without being mounted normally on the mounting groove 610. Accordingly, referring to FIG. 19, the first ice bucket 310 on which the first pad 400 is mounted may be spaced apart from the bottom wall 601 of the drawer 600.

Therefore, with the configuration of the protrusion 490, the mounting groove 610, and the interference members 620*a* and 620*b*, a user can intuitively recognize the assembly direction in the left and right direction of the first ice bucket 310 on which the first pad 400 is mounted.

Figure 20:
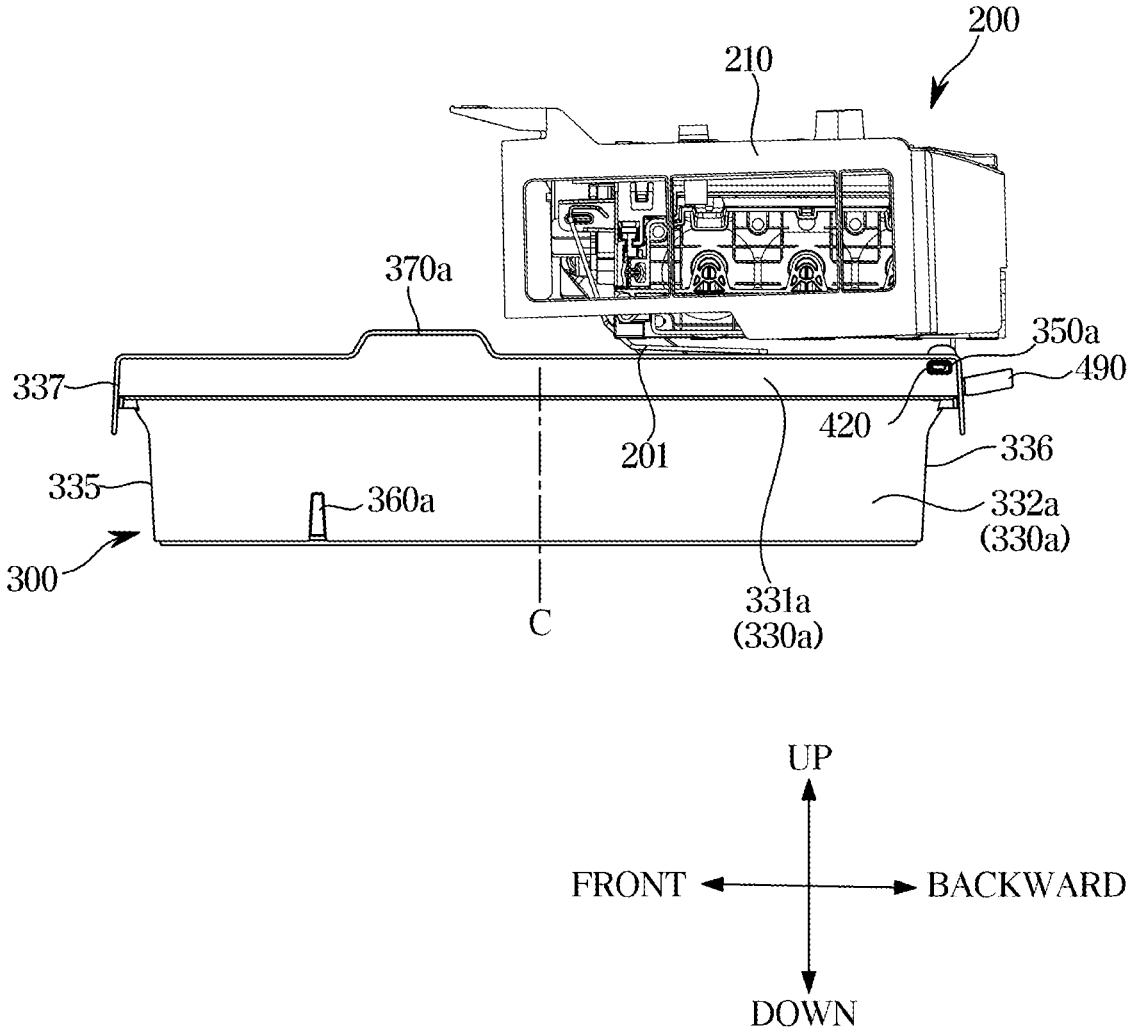
FIG. 20 is a side view illustrating a state in which the ice bucket is arranged normally under an ice maker according to an embodiment of the disclosure.
Figure 21:
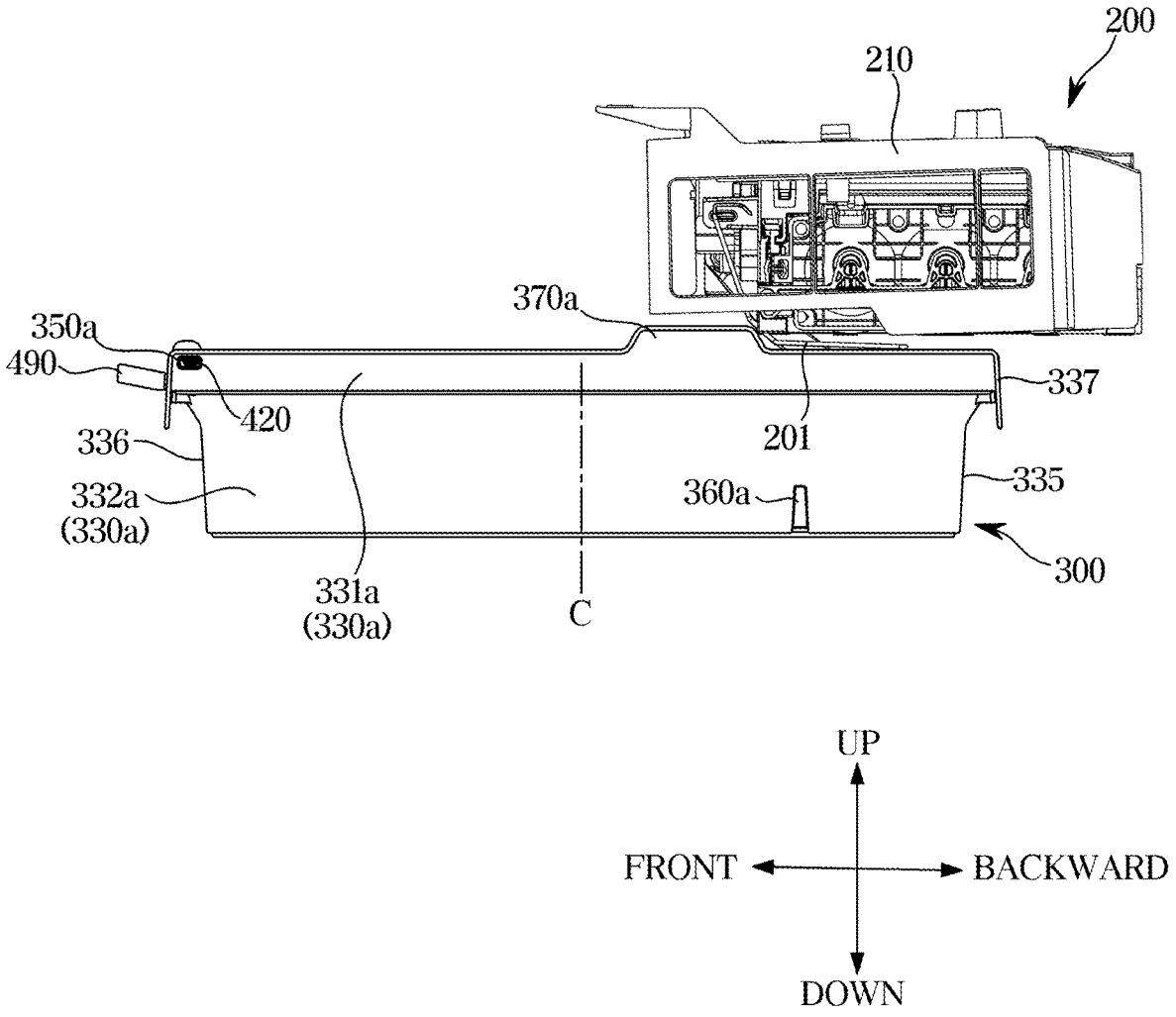
FIG. 21 is a side view illustrating a state in which the ice bucket is arranged abnormally under the ice maker according to an embodiment of the disclosure.

FIG. 20 is a side view illustrating a state in which the ice bucket is arranged normally under an ice maker. FIG. 21 is a side view illustrating a state in which the ice bucket is arranged abnormally under the ice maker.

The ice bucket 300 may be arranged under the ice maker 200. The ice maker 200 may be arranged to allow ice to fall in the rear portion of the inner space 300*s* of the ice bucket 300.

Particularly, the first pad 400 may be mounted inside the first ice bucket 310. In this case, the inclined member 410 may be arranged in the rear portion of the first ice bucket 310 and the base 450 may be arranged in the front portion of the first ice bucket 310. Accordingly, the spherical-shaped ice produced by the first ice making unit 210 of the ice maker 200 may fall to the inclined member 410 of the first pad 400 arranged in the rear portion of the first ice bucket 310.

Based on the ice bucket 300 being arranged normally under the ice maker 200, that is, when the rear portion of the first ice bucket 310 provided with the inclined member 410 is arranged toward the ice maker 200, the protruding member 370*a* of the ice bucket 300 may be forwardly spaced apart from the ice maker 200, and thus the ice bucket 300 may not interfere with the lower end 201 of the ice maker 200.

Referring to FIG. 21, on the contrary, based on the ice bucket 300 being arranged abnormally under the ice maker 200, that is, when the front portion of the first ice bucket 310, in which the base 450 is provided, is arranged toward the ice maker 200, the protruding member 370*a* of the ice bucket 300 may interfere with the lower end 201 of the ice maker 200, and thus the ice bucket 300 may no longer be inserted backward. Accordingly, a user can intuitively recognize that the ice bucket 300 is incorrectly assembled in the front and rear direction.

As is apparent from the above description, it is possible to reduce an impact and noise that is generated when ice produced by an ice maker falls into an ice bucket.

Further, it is possible to increase an amount of ice stored in an ice bucket.

Further, it is possible to prevent incorrect assembly in a front and rear direction upon assembling an ice-making assembly.

Further, it is possible to prevent incorrect assembly in a left and right direction upon assembling an ice-making assembly.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an ice maker configured to produce ice;

an ice bucket positionable under the ice maker and including a first position guide and a third position guide; and a pad mountable to the ice bucket and including a base, an inclined member, a second position guide, and a fourth position guide, wherein one of the third position guide and the fourth position guide includes an interference groove recessed inward, and the other one of the third position guide and the fourth position guide includes an interference protrusion, and the pad and the ice bucket are configured so that, when the pad is being normally mounted to the ice bucket, the second position guide couples with the first position guide to guide positioning of the pad in the ice bucket and the interference groove engages with the interference protrusion to guide the base so that, when the pad is normally mounted to the ice bucket, the base is in a front portion of the ice bucket and the inclined member is in a rear portion of the ice bucket and is inclined to the base, when the pad is abnormally mounted to the ice bucket, the base is in the rear portion of the ice bucket, the inclined member is in the front portion of the ice bucket, and the interference protrusion supports, and thereby lifts, a bottom of the pad, and, when the pad is normally mounted to the ice bucket and the ice bucket is positioned under the ice maker, the ice produced by the ice maker falls into the ice bucket and is transferred by the inclined member to the base.

2. The refrigerator of claim 1, wherein, when the pad is normally mounted in the ice bucket, the first position guide and the second position guide are coupled to each other to maintain a position of the pad relative to the ice bucket.

3. The refrigerator of claim 1, wherein:

one of the first position guide and the second position guide includes an insertion groove, and the other of the first position guide and the second position guide includes an insertion protrusion coupleable to the insertion groove.

4. The refrigerator of claim 1, wherein:

the pad includes a side edge extending in a front-backward direction to form a periphery of the pad, and the second position guide is at a position biased in a direction from a midpoint of the side edge.

5. The refrigerator of claim 1, wherein:

the pad includes:

a first side edge extending in a front-backward, and a second side edge opposite to the first side edge, wherein the second position guide is only on the first side edge.

6. The refrigerator of claim 1, wherein:

the second position guide is in the inclined member, and the fourth position guide is in the base.

7. The refrigerator of claim 1, wherein the ice bucket includes an upper edge extending in a front-backward direction to form a periphery of the ice bucket, and a protrusion at a position biased forward from a midpoint of the upper edge and protruding upward to interfere with a lower end of the ice maker to guide the ice bucket when the ice bucket is being positioned under the ice maker.

8. The refrigerator of claim 7, wherein the protrusion is forwardly spaced apart from the ice maker when the ice bucket is positioned under the ice maker.

9. The refrigerator of claim 1, wherein the inclined member includes a guide member protruding from a center of the inclined member to guide the ice, falling from the ice maker, to a left side or a right side of the base.

10. The refrigerator of claim 1, wherein:

the inclined member includes an extension protruding upwardly to be exposed to an outside of the ice bucket, and the second position guide is in the extension.

11. The refrigerator of claim 1, wherein the ice maker is configured to produce spherical-shaped ice.

12. A refrigerator comprising:

an ice maker including a first ice making unit configured to produce a first type of ice, and a second ice making unit configured to produce a second type of ice;

a first ice bucket positionable under the first ice making unit to receive the first type of ice;

a second ice bucket positionable under the second ice making unit to receive the second type of ice;

a drawer in which the first ice bucket and the second ice bucket are mountable side by side, the drawer including:

a rear wall having a mounting groove, a first interference member positioned at a first side of the mounting groove, a second interference member positioned at a second side, opposite to the first side, of the mounting groove, a first side wall bent from the first interference member so as to extend forward from the first interference member, and a second side wall bent from the second interference member so as to extend forward from the second interference member; and a pad mountable to the first ice bucket, the pad including:

an outer edge extending in a front to rear direction to form a periphery of the pad and being adjacent to one of the first side wall and the second side wall of the drawer when the pad is mounted in the first ice bucket and the first ice bucket is normally mounted in the drawer, an inner edge adjacent to a center of the drawer when the pad is mounted to the first ice bucket and the first ice bucket is normally mounted in the drawer, and a protrusion extending backward and configured so that, when the pad is mounted to the first ice bucket and the first ice bucket is being normally mounted in the drawer, the protrusion becomes mounted in the mounting groove so as to guide normal positioning of the first ice bucket in the drawer, and so that, when the pad is mounted to the first ice bucket and the first ice bucket is being abnormally mounted in the drawer, the protrusion interferes with one of the first interference member and the second interference member so as to be lifted without becoming mounted in the mounting groove.

13. The refrigerator of claim 12, wherein the first ice bucket, to which the pad is mounted, is provided so that the protrusion of the pad interferes with the one of the first interference member and the second interference member in response to the inner edge of the pad being arranged to face the one of the first side wall and the second side wall of the drawer.

14. The refrigerator of claim 12, wherein the pad has a bottom surface inclined so that a rear portion of the bottom surface is higher than a front portion of the bottom surface when the pad is mounted to the first ice bucket.

* * * * *